US007918173B2

(12) United States Patent
Duquette et al.

(10) Patent No.: US 7,918,173 B2
(45) Date of Patent: Apr. 5, 2011

(54) PERSONAL WATERCRAFT HAVING AN ADJUSTABLE SUSPENSION

(75) Inventors: Mathieu Duquette, Sherbrooke (CA); Pascal Toupin, Sherbrooke (CA); Charles Desilets, Sherbrooke (CA)

(73) Assignee: Bombardier Recreational Products Inc., Valcourt (CA)

( * ) Notice: Subject to any disclaimer, the term of this patent is extended or adjusted under 35 U.S.C. 154(b) by 168 days.

(21) Appl. No.: 12/262,987

(22) Filed: Oct. 31, 2008

(65) Prior Publication Data

US 2009/0107380 A1 Apr. 30, 2009

Related U.S. Application Data

(60) Provisional application No. 60/984,148, filed on Oct. 31, 2007.

(51) Int. Cl.
*B63B 35/73* (2006.01)

(52) U.S. Cl. ..... 114/55.57

(58) Field of Classification Search ..... 114/55.5, 114/55.57; 188/297; 701/21
See application file for complete search history.

(56) References Cited

U.S. PATENT DOCUMENTS 5,542,371 A * 8/1996 Harvey et al. ..... 114/363
5,603,281 A * 2/1997 Harvey et al. ..... 114/363
6,019,054 A * 2/2000 Hattori et al. ..... 114/55.57
6,152,062 A 11/2000 Hattori
6,892,666 B1 5/2005 Plante et al.

* cited by examiner

*Primary Examiner* — Daniel V Venne
(74) *Attorney, Agent, or Firm* — Osler, Hoskin & Harcourt LLP

(57) ABSTRACT

A personal watercraft has a hull and sub-deck (HSD) assembly, a deck above the sub-deck, and a suspension member pivotally connected therebetween. A suspension element, including a spring assembly, is connected between any two of the deck, the HSD assembly, and the suspension member. The spring assembly has first and second portions having first and second spring rates respectively. The second spring rate is greater than the first. A controller controls a lifting device to set an initial distance between the deck and the sub-deck to one of a first distance and a second distance greater than the first. The suspension element moves through a majority of a full stroke with the first portion of the spring assembly at least partially expanded when the initial distance is the first distance, and with the first portion of the spring assembly fully compressed when the initial distance is the second distance.

21 Claims, 28 Drawing Sheets

PERSONAL WATERCRAFT HAVING AN ADJUSTABLE SUSPENSION

CROSS-REFERENCE

This application claims priority to U.S. Provisional Patent Application No. 60/984,148, filed Oct. 31, 2007, the entirety of which is incorporated herein by reference.

FIELD OF THE INVENTION

The present invention relates to personal watercraft having an adjustable suspension.

BACKGROUND OF THE INVENTION

Most of today's commercially available personal watercraft have a hull and a deck disposed directly thereon. The deck has a pedestal onto which a straddle-type seat is disposed. When such watercraft travel over waves, the forces due to impacts between the hull and the waves are transferred to the driver and passengers which can make the riding experience uncomfortable, especially over long distances. The only cushioning against these impacts is provided by the padding in the seat.

In an effort to minimize the transfer of these forces to the driver and passengers, some watercraft have a suspension element, such as a spring and damper assembly, disposed between the seat and the deck. Although this reduces the transfers of these forces to the body of the driver and passengers, this arrangement tends to still solicit the legs of the driver and passengers since the seat now moves relative to the footrests formed in the deck as well as, for the driver, the hands and arms that have to follow the movement of the helm assembly.

Another way to minimize the transfer of these forces to the driver and passengers consists in suspending the whole deck above the hull. The engine, fuel tank, and propulsion system are still in and/or connected to the hull and a sub-deck is disposed on the hull to protect the components in the hull from water. The hull and sub-deck together form a hull and sub-deck assembly (HSD) assembly. The deck is suspended on the HSD assembly. In this arrangement, the footrest can still be formed with the deck, and as such the legs of the drivers and passengers are less solicited than in watercraft where only the seat is suspended.

One problem when designing a personal watercraft having a suspended deck is that the weight of the driver, passengers, and/or cargo will have a large impact on the performance of the suspension.

In other vehicles such as cars or motorcycles, the majority of the weight of the vehicle is suspended. In a motorcycle for example, the frame, engine, fuel tank, and seat, to name a few, are all suspended on the wheels of the motorcycle. Since the suspended mass is relatively large, the mass of the driver, the presence or absence of passengers and/or cargo has little effect. This is because the mass of an additional passenger is only a small percentage of the suspended mass of the motorcycle. This percentage is even smaller for a car. As such, the suspensions for these vehicles can be designed for one suspended mass (suspended mass of vehicle plus an estimated mass to take into account loading of the vehicle) and will operate adequately regardless of the mass of the driver, the presence or absence of passengers and/or cargo.

In watercraft where the deck is suspended, a fair amount of the mass is not suspended since the heavier components are in the hull. The deck itself is fairly light in comparison. Thus the amount of load on the deck has a significant effect. The presence of a driver, passengers, and cargo can triple the mass suspended on the HSD assembly, if not more. This means that the suspension needs to accommodate these larger variations. Using a spring that is having a low spring rate will cause the suspension to operate adequately when only a driver is present on the deck, but may cause the deck to impact the HSD assembly when passengers and cargo are also on the deck. Using a spring having a high spring rate will cause the deck to operate adequately when a driver, passenger, and cargo are on the deck, but will be too stiff when only a driver is present, thus not absorbing the forces being transferred to the HSD assembly as effectively.

Therefore, there is a need for a personal watercraft having a suspension that can operate adequately over a wide range of load on the deck.

Also, personal watercraft can be used in different conditions. These can vary from the high waves of the ocean to the relatively flat water of a lake. In the first example a stiffer suspension would be preferred, however in the second example a softer suspension would be preferred to better absorb the forces. Different drivers may also want different riding experiences. Some may want to feel the waves while others may want a more stable and comfortable ride.

Therefore, there is also a need for a personal watercraft having a suspension that can accommodate different riding conditions and/or driver preferences.

SUMMARY OF THE INVENTION

It is an object of the present invention to ameliorate at least some of the inconveniences present in the prior art.

It is also an object of the present invention to provide a personal watercraft having an adjustable suspension.

It is another object of the present invention to provide a personal watercraft having a suspension including a spring assembly having a first portion having a first spring rate and a second portion having a second spring rate, where the second spring rate is greater than the first spring rate.

It is yet another object of the present invention to provide a personal watercraft having a suspension with different settings.

It is a further object of the present invention to provide a method of controlling a suspension of a personal watercraft.

In one aspect, the invention provides a personal watercraft having a hull and a sub-deck disposed on the hull. The hull and sub-deck together form a hull and sub-deck (HSD) assembly. An engine is disposed in the HSD assembly. A propulsion system is connected to the hull and is operatively connected to the engine. A deck is disposed above the sub-deck. The deck has a pedestal. A straddle-type seat is disposed on the pedestal. A helm assembly is operatively connected to the propulsion system and is disposed at least in part forwardly of the straddle-type seat. A suspension member has a first end pivotally connected to the deck and a second end pivotally connected to the HSD assembly, such that the HSD assembly is movable relative to the deck between a topped-out position and a bottomed-out position. The topped-out position being the position where the deck is furthest from the sub-deck. The bottomed-out position being the position where the deck is closest to the sub-deck. The suspension member has a fixed length. A suspension element is connected between any two of the deck, the HSD assembly, and the suspension member. The suspension element includes a spring assembly. The spring assembly has a first portion having a first spring rate and a second portion having a second spring rate. The second spring rate is greater than the first spring rate. Movement of the HSD assembly from the topped-out position to the bottomed-out position results in the suspension element moving through a full stroke of the suspension element. A lifting device is associated with the spring assembly for moving the deck relative to the sub-deck. A controller is associated with the lifting device. The controller controls the lifting device to set an initial distance between the deck and the sub-deck to one of a first distance and a second distance. The second distance is greater than the first distance. When the controller controls the lifting device to set the initial distance between the deck and the sub-deck to be the first distance, the suspension element moves through a majority of the full stroke with the first portion of the spring assembly at least partially expanded. When the controller controls the lifting device to set the initial distance between the deck and the sub-deck to be the second distance, the suspension element moves through a majority of the full stroke with the first portion of the spring assembly fully compressed.

In an additional aspect, the spring assembly is a dual rate spring having the first and second portions of the spring assembly integrally formed.

In a further aspect, the suspension element is a first suspension element. The personal watercraft also has a second suspension element including a hydraulic damper. The second suspension element is connected between any two of the deck, the HSD assembly, and the suspension member.

In another aspect, the hydraulic damper is a dual rate hydraulic damper.

In an additional aspect, the lifting device forms part of the suspension element.

In a further aspect, a first portion of the lifting device is pivotally connected to one of the HSD assembly and the suspension member, a second portion of the lifting device opposite the first portion of the lifting device is connected to one of the first and second portions of the spring assembly, and an other of the first and second portions of the spring assembly is connected to the deck.

In an additional aspect, the first portion of the lifting device has a piston formed at an end thereof opposite an end that is pivotally connected to the suspension member. The second portion of the lifting device is disposed around the piston and is slidable relative to the first portion of the lifting device. A first chamber having an adjustable volume is formed between the second portion of the lifting device and the piston. The lifting device further includes an inlet fluidly communicating with the first chamber for introducing hydraulic fluid in the first chamber. When hydraulic fluid is introduced in the first chamber, the volume of the first chamber increases.

In a further aspect, the personal watercraft also has a hydraulic cylinder. The hydraulic cylinder includes a cylinder housing and a piston disposed in the cylinder housing. The cylinder housing and the piston together form a second chamber having an adjustable volume. An outlet fluidly communicates with the second chamber for allowing hydraulic fluid to leave the second chamber. The outlet fluidly communicates with the inlet of the first chamber of the lifting device. A piston rod has a first end connected to the piston and a second threaded end. A threaded rod is associated with the threaded end of the piston rod. A motor is operatively connected to the threaded rod for turning the threaded rod, such that turning the threaded rod moves the piston rod and the piston linearly in the cylinder housing to change the volume of the second chamber. Operation of the motor is controlled by the controller. Turning the threaded rod to reduce the volume of the second chamber causes hydraulic fluid to leave the second chamber and enter the first chamber to increase the volume of the first chamber.

In an additional aspect, the personal watercraft also has at least one sensor for sensing a position of the deck relative to the HSD assembly and a speed of the deck relative to the HSD assembly. The at least one sensor is electrically connected to the controller for providing at least one signal indicative of the position and speed of the deck relative to the HSD. The controller includes at least one map used for determining the initial distance to be set based on the at least one signal. The controller controls the lifting device to set the initial distance based on the map.

In a further aspect, the controller includes at least one manual control disposed on the helm assembly. Actuating the at least one manual control controls the lifting device.

In another aspect, the invention provides personal watercraft having a hull and a sub-deck disposed on the hull. The hull and sub-deck together form a hull and sub-deck (HSD) assembly. An engine is disposed in the HSD assembly. A propulsion system is connected to the hull and is operatively connected to the engine. A deck is disposed above the sub-deck. The deck has a pedestal. A straddle-type seat is disposed on the pedestal. A helm assembly is operatively connected to the propulsion system and is disposed at least in part forwardly of the straddle-type seat. A suspension member has a first end pivotally connected to the deck and a second end pivotally connected to the HSD assembly, such that the HSD assembly is movable relative to the deck between a topped-out position and a bottomed-out position. The topped-out position is the position where the deck is furthest from the sub-deck. The bottomed-out position is the position where the deck is closest to the sub-deck. The suspension member has a fixed length. A suspension element is connected between any two of the deck, the HSD assembly, and the suspension member. The suspension element includes a spring assembly. The spring assembly has a first portion having a first spring rate and a second portion having a second spring rate. The second spring rate is greater than the first spring rate. Movement of the HSD assembly from the topped-out position to the bottomed-out position results in the suspension element moving through a full stroke of the suspension element. A lifting device is associated with the spring assembly for moving the deck relative to the sub-deck. A controller is associated with the lifting device. The controller controls the lifting device to set a sagged position of the deck relative to the sub-deck to one of a first position and a second position. The second position being at a greater distance from the sub-deck than the first position. When the controller controls the lifting device to set the sagged position to be the second position, the suspension element moves from a midpoint of the full stroke to an end of the full stroke with the first portion of the spring assembly fully compressed.

In an additional aspect, when the controller controls the lifting device to set the sagged position to be the first position, the suspension element moves from a beginning of the full stroke to the end of the full stroke with the first portion of the spring assembly at least partially expanded.

In a further aspect, the spring assembly is a dual rate spring having the first and second portions of the spring assembly integrally formed.

In an additional aspect, the suspension element is a first suspension element. The personal watercraft also has a second suspension element including a hydraulic damper. The second suspension element is connected between any two of the deck, the HSD assembly, and the suspension member.

In another aspect, the hydraulic damper is a dual rate hydraulic damper.

In a further aspect, the lifting device forms part of the suspension element.

In an additional aspect, a first portion of the lifting device is pivotally connected to one of the HSD assembly and the suspension member, a second portion of the lifting device opposite the first portion of the lifting device is connected to one of the first and second portions of the spring assembly, and an other of the first and second portions of the spring assembly is connected to the deck.

In a further aspect, the first portion of the lifting device has a piston formed at an end thereof opposite an end that is pivotally connected to the suspension member. The second portion of the lifting device is disposed around the piston and is slidable relative to the first portion of the lifting device. A first chamber having an adjustable volume is formed between the second portion of the lifting device and the piston. The lifting device further includes an inlet fluidly communicating with the first chamber for introducing hydraulic fluid in the first chamber. When hydraulic fluid is introduced in the first chamber, the volume of the first chamber increases.

In an additional aspect, the personal watercraft also includes a hydraulic cylinder. The hydraulic cylinder includes a cylinder housing and a piston disposed in the cylinder housing. The cylinder housing and the piston together form a second chamber having an adjustable volume. An outlet fluidly communicates with the second chamber for allowing hydraulic fluid to leave the second chamber. The outlet fluidly communicates with the inlet of the first chamber of the lifting device. A piston rod has a first end connected to the piston and a second threaded end. A threaded rod is associated with the threaded end of the piston rod. A motor is operatively connected to the threaded rod for turning the threaded rod, such that turning the threaded rod moves the piston rod and the piston linearly in the cylinder housing to change the volume of the second chamber. Operation of the motor is controlled by the controller. Turning the threaded rod to reduce the volume of the second chamber causes hydraulic fluid to leave the second chamber and enter the first chamber to increase the volume of the first chamber.

In a further aspect, the personal watercraft also has at least one sensor for sensing a position of the deck relative to the HSD assembly and a speed of the deck relative to the HSD assembly. The at least one sensor is electrically connected to the controller for providing at least one signal indicative of the position and speed of the deck relative to the HSD. The controller includes at least one map used for determining the initial distance to be set based on the at least one signal. The controller controls the lifting device to set the initial distance based on the map.

In an additional aspect, he controller includes at least one manual control disposed on the helm assembly. Actuating the at least one manual control controls the lifting device.

In yet another aspect, the invention provides a method of controlling a suspension of a personal watercraft. The personal watercraft includes a hull, a sub-deck disposed on the hull, the hull and sub-deck together forming a hull and sub-deck (HSD) assembly, an engine disposed in the HSD assembly, a propulsion system connected to the hull and operatively connected to the engine, a deck disposed above the sub-deck, the deck having a pedestal, a straddle-type seat disposed on the pedestal, a helm assembly operatively connected to the propulsion system and disposed at least in part forwardly of the straddle-type seat, a suspension member having a first end pivotally connected to the deck and a second end pivotally connected to the HSD assembly, such that the HSD assembly is movable relative to the deck between a topped-out position and a bottomed-out position, the topped-out position being the position where the deck is furthest from the sub-deck, the bottomed-out position being the position where the deck is closest to the sub-deck, a suspension element connected between any two of the deck, the HSD assembly, and the suspension member, the suspension element including a spring assembly, movement of the HSD assembly from the topped-out position to the bottomed-out position resulting in the suspension element moving through a full stroke of the suspension element, and a lifting device associated with the spring assembly for moving the deck relative to the sub-deck. The method comprises determining a position of the deck relative to the sub-deck; causing the lifting device to increase a distance between the deck and the sub-deck when the distance between the deck and the sub-deck is less than a first predetermined distance; and causing the lifting device to set an average distance between the deck and the sub-deck over time to a second predetermined distance, greater than the first predetermined distance, when the distance between the deck and the sub-deck is generally stable over time.

In a further aspect, the method further comprises causing the lifting device to increase the distance between the deck and the sub-deck in response to a first switch being actuated; and causing the lifting device to decrease the distance between the deck and the sub-deck in response to a second switch being actuated.

In an additional aspect, the method further comprises determining a speed of the watercraft; and causing the lifting device to move the deck to a dock position relative to the sub-deck when the speed of the watercraft is less than a predetermined speed.

In a further aspect, the dock position is the bottomed-out position.

In an additional aspect, the method further comprises causing the lifting device to move the deck to a dock position relative to the sub-deck when the engine stops.

For purposes of this application, terms related to spatial orientation such as forwardly, rearwardly, left, and right, are as they would normally be understood by a driver of the vehicle sitting thereon in a normal riding position.

Embodiments of the present invention each have at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION OF THE PREFERRED EMBODIMENTS

Figure 5:
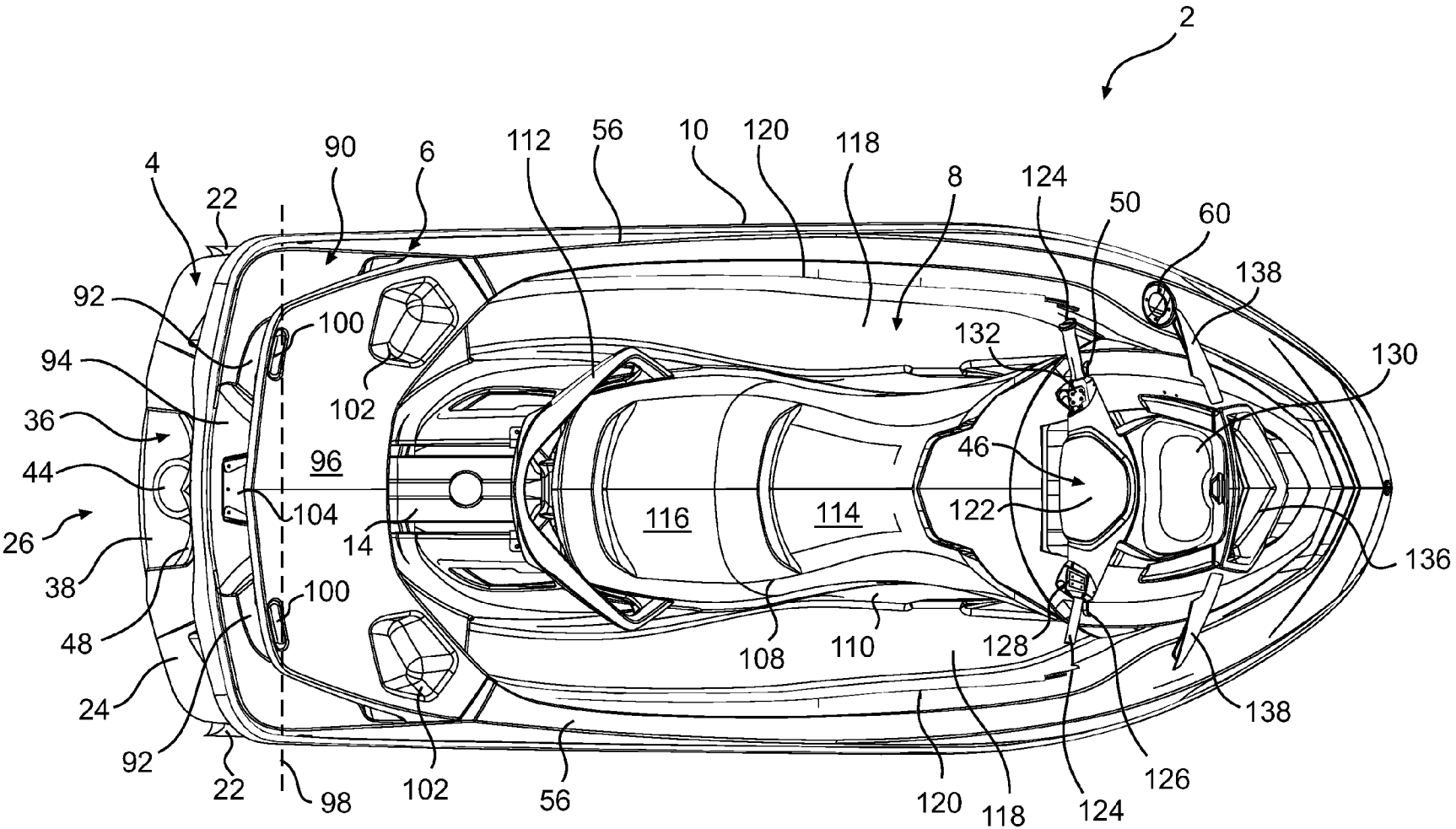
FIG. 5 is a perspective view, taken from a top, rear side, of the watercraft of FIG. 1.
Figure 6:
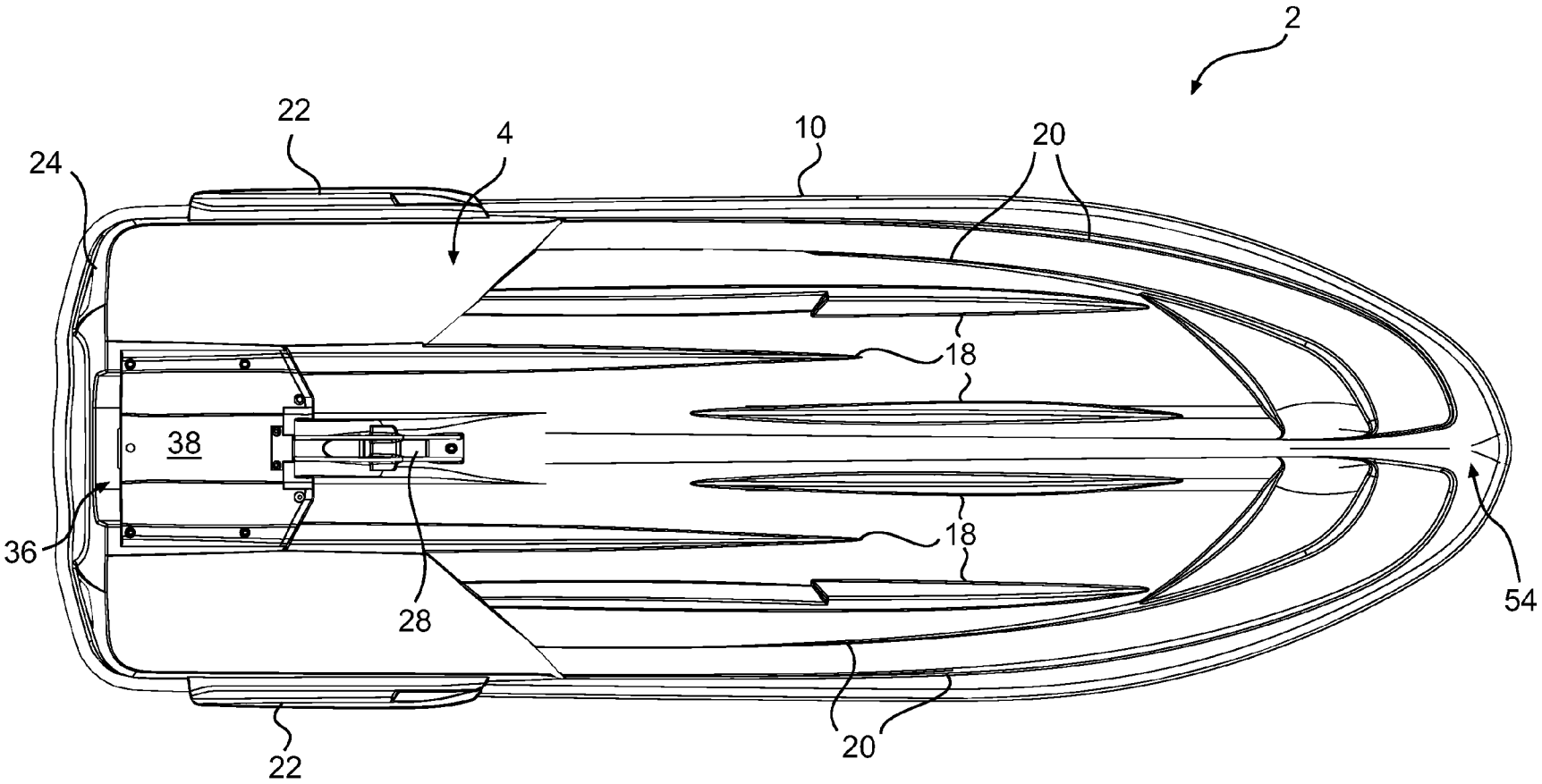
FIG. 6 is a bottom plan view of the watercraft of FIG. 1.
Figure 7:
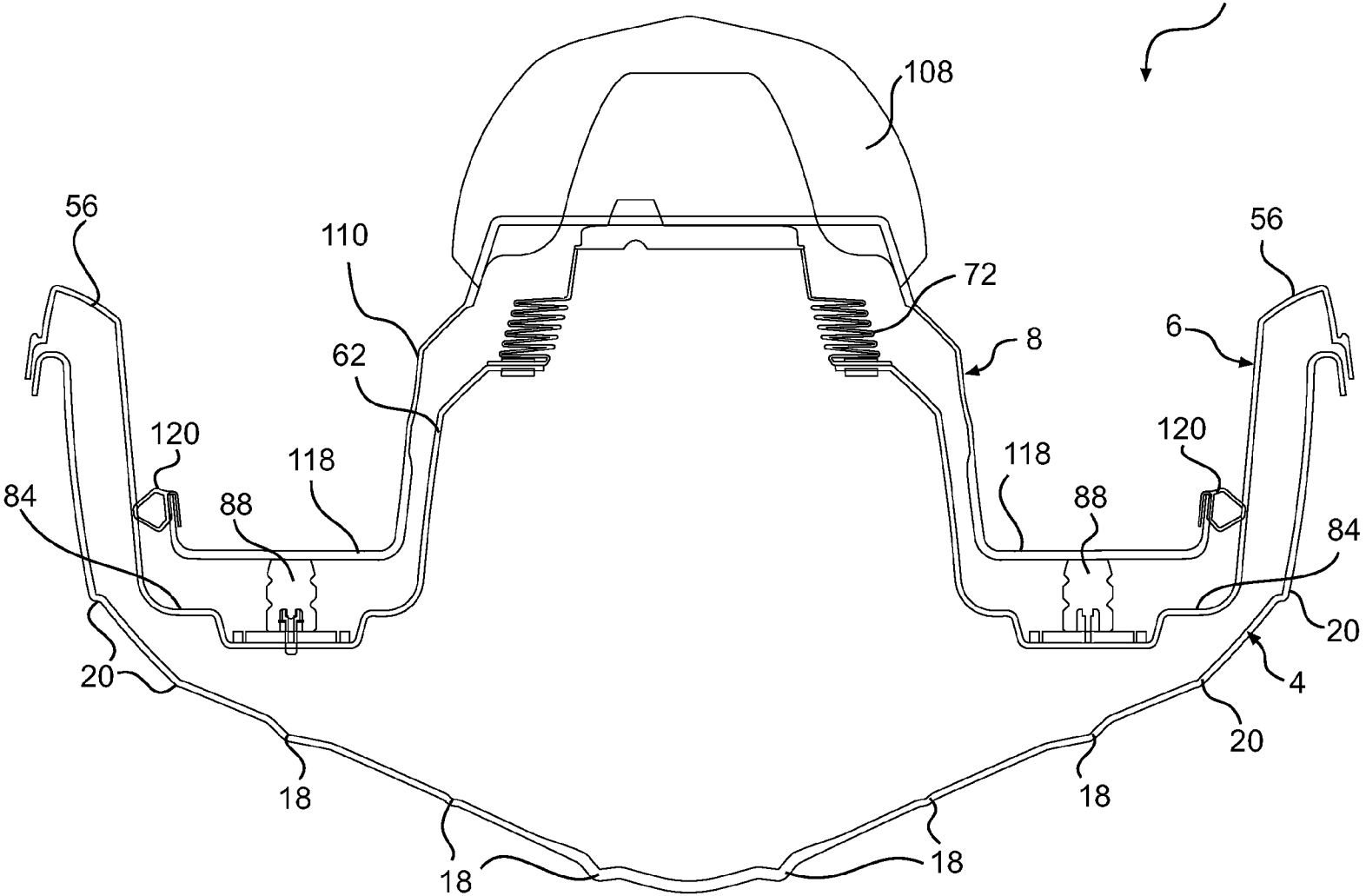
FIG. 7 is a schematic view of a transverse cross-section of the watercraft of FIG. 1.
Figure 8:
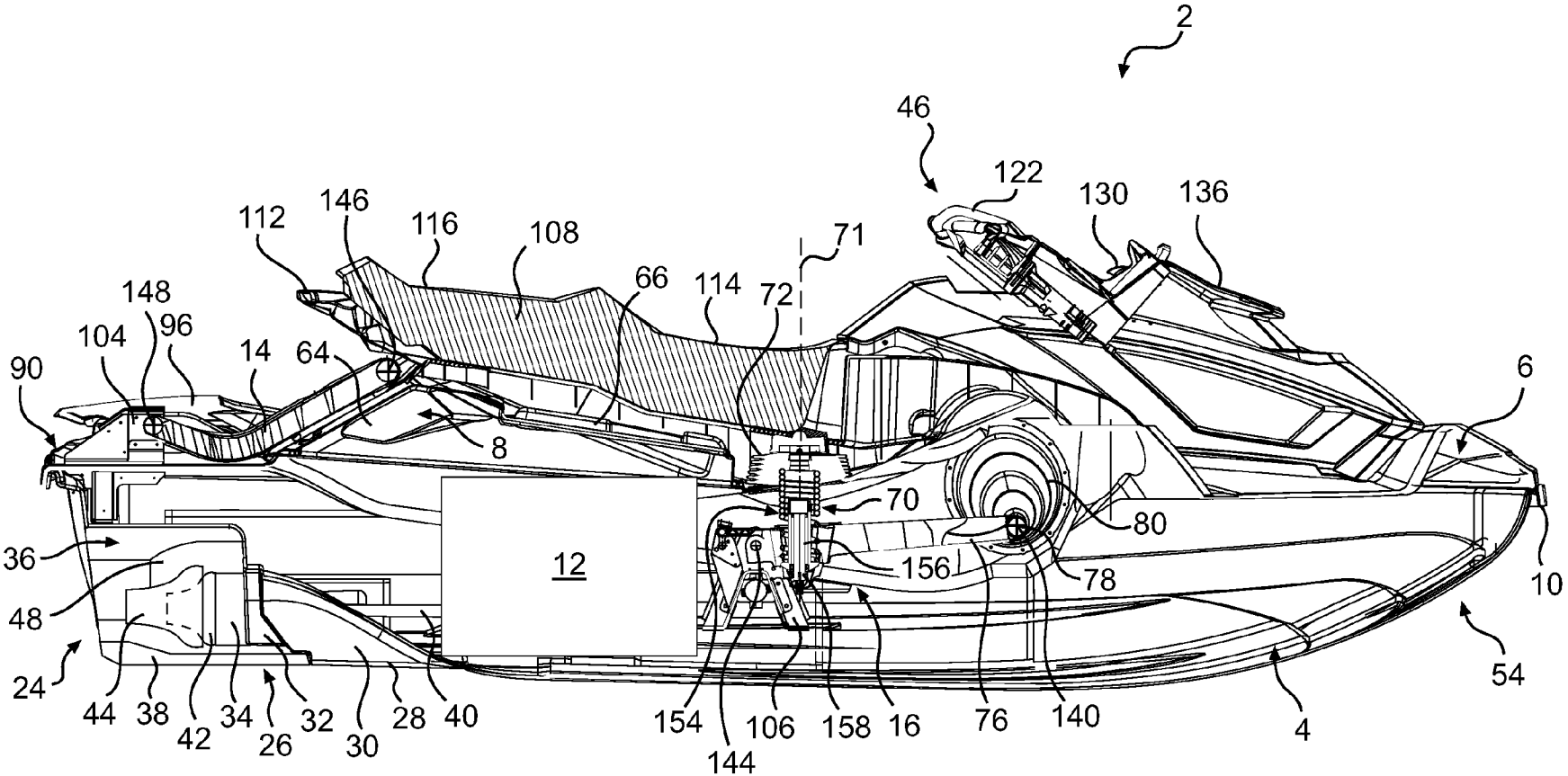
FIG. 8 is a partial longitudinal cross-section of the watercraft of FIG. 1 showing some of the internal components thereof.
Figure 9:
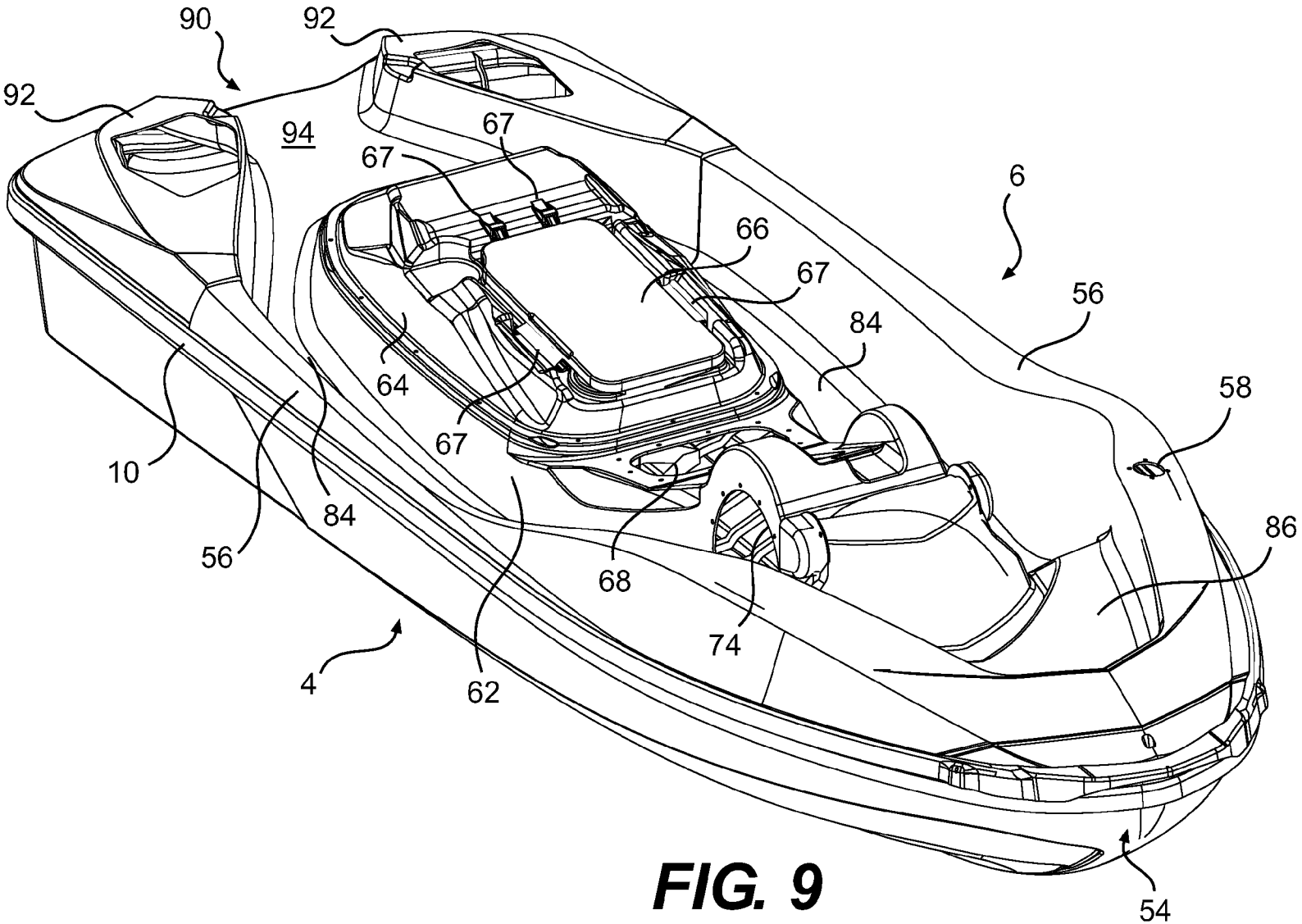
FIG. 9 is a perspective view, taken from a front, right side, of a hull and sub-deck assembly of the watercraft of FIG. 1, with the engine cowling thereon.
Figure 10:
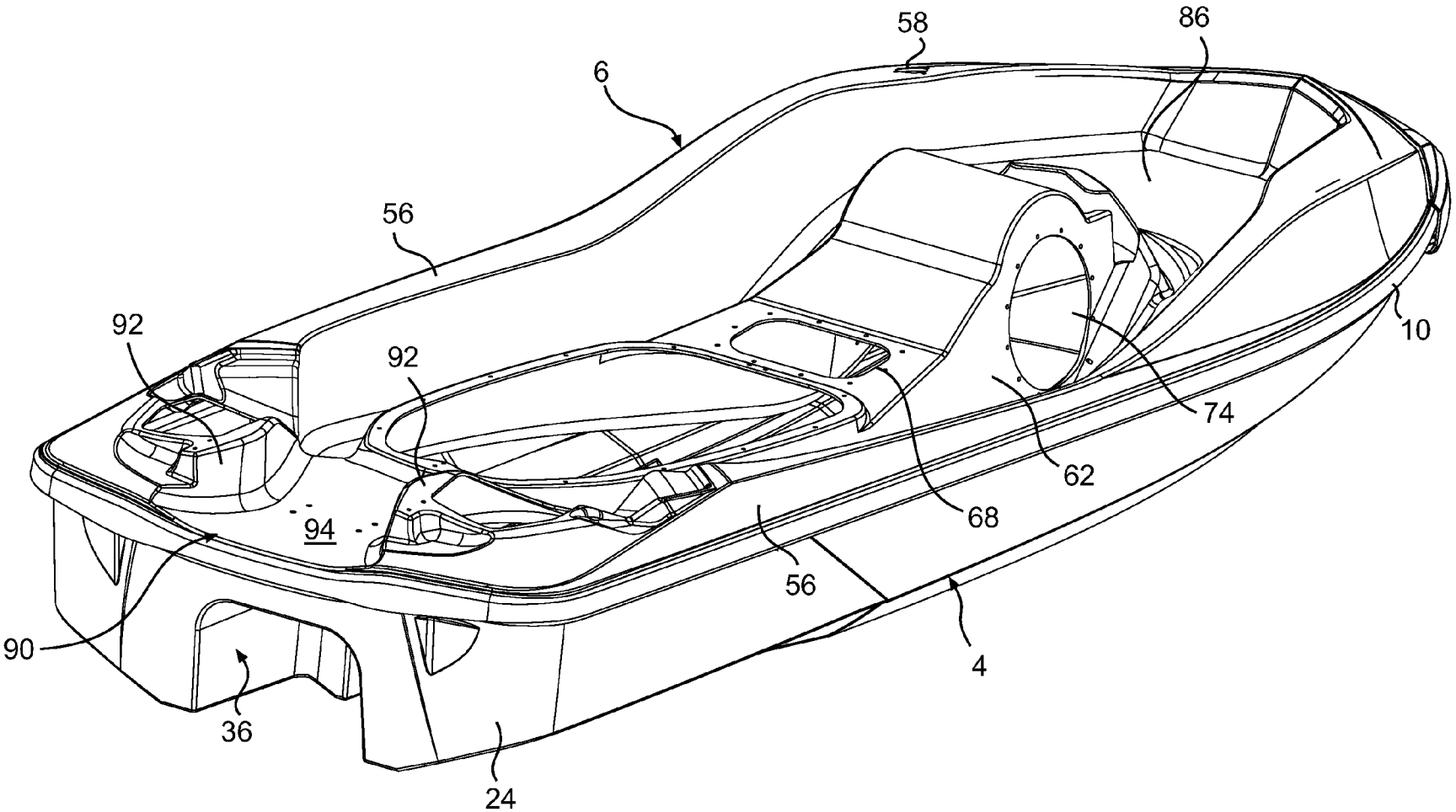
FIG. 10 is a perspective view, taken from a rear, right side, of the hull and sub-deck assembly of FIG. 9, with the engine cowling removed.
Figure 11:
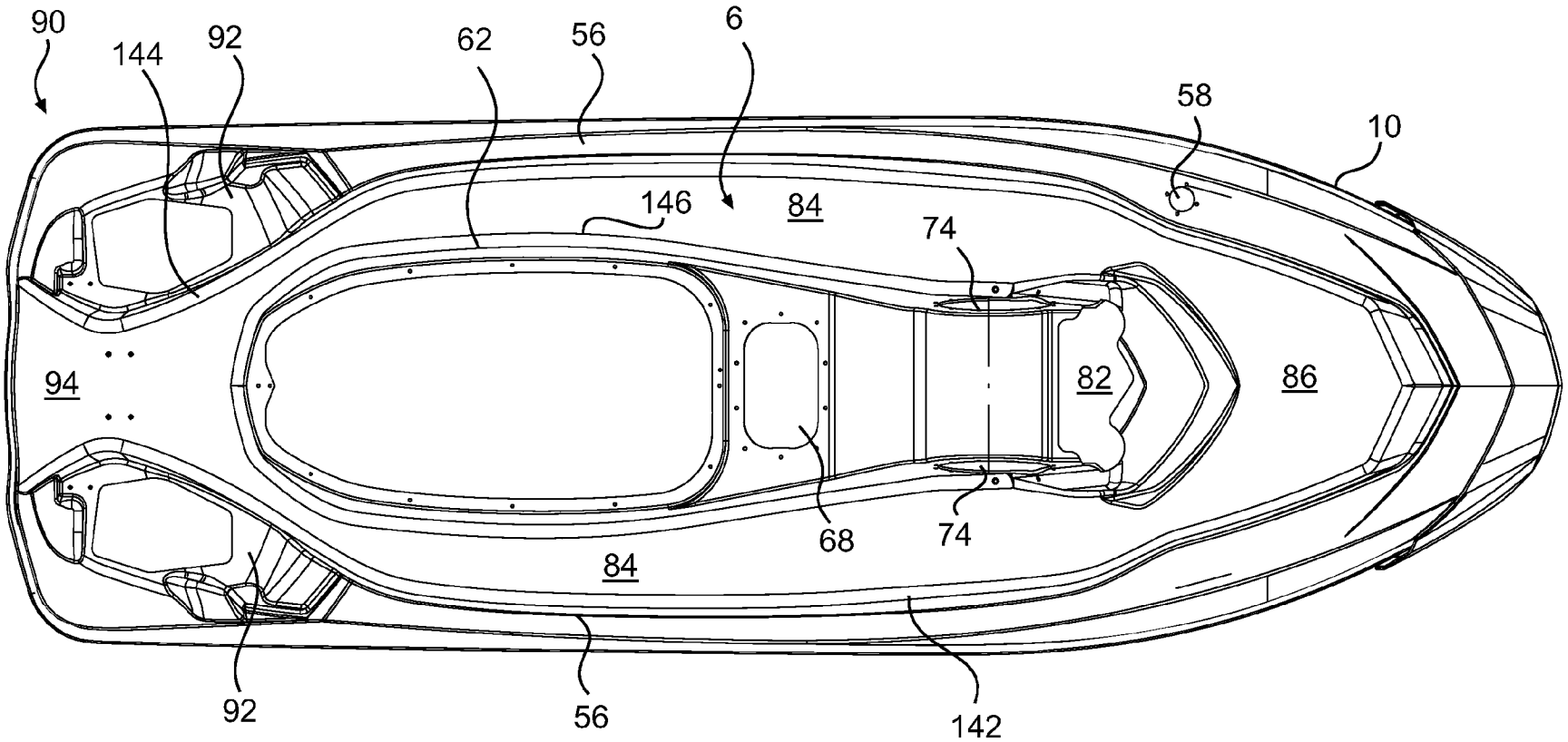
FIG. 11 is a top plan view of the hull and sub-deck assembly of FIG. 9, with the engine cowling removed.

Turning to FIGS. 1 to 12, a personal watercraft 2 will be described. The watercraft 2 is made of three main parts. These parts are the hull 4, the sub-deck 6, and the deck 8. As best seen in FIGS. 9 to 11, the hull 4 and sub-deck 6 are joined together, preferably by an adhesive, to form a hull and sub-deck (HSD) assembly. Rivets or other fasteners may also join the hull 4 and sub-deck 6. A bumper 10 generally covers the joint helping to prevent damage to the outer edge of the watercraft 2 when the watercraft 2 is docked. The volume created between the hull 4 and the sub-deck 6 is known as the engine compartment. The engine compartment accommodates the engine 12 (schematically shown in FIG. 8) as well as the muffler, exhaust pipe, gas tank, electrical system (including for example a battery and an electronic control unit), air box, storage bins (not shown) and other elements required by or desired for the watercraft 2. The deck 8 (FIG. 3) is designed to accommodate a driver and one or more passengers. As best seen in FIGS. 7 and 8, the deck 8 is suspended on the HSD assembly by a rear suspension member in the form of a rear suspension arm 14 and a front suspension assembly 16 described in greater detail below. Both the front and rear suspension arms 14, 16 have a fixed length.

Figure 1:
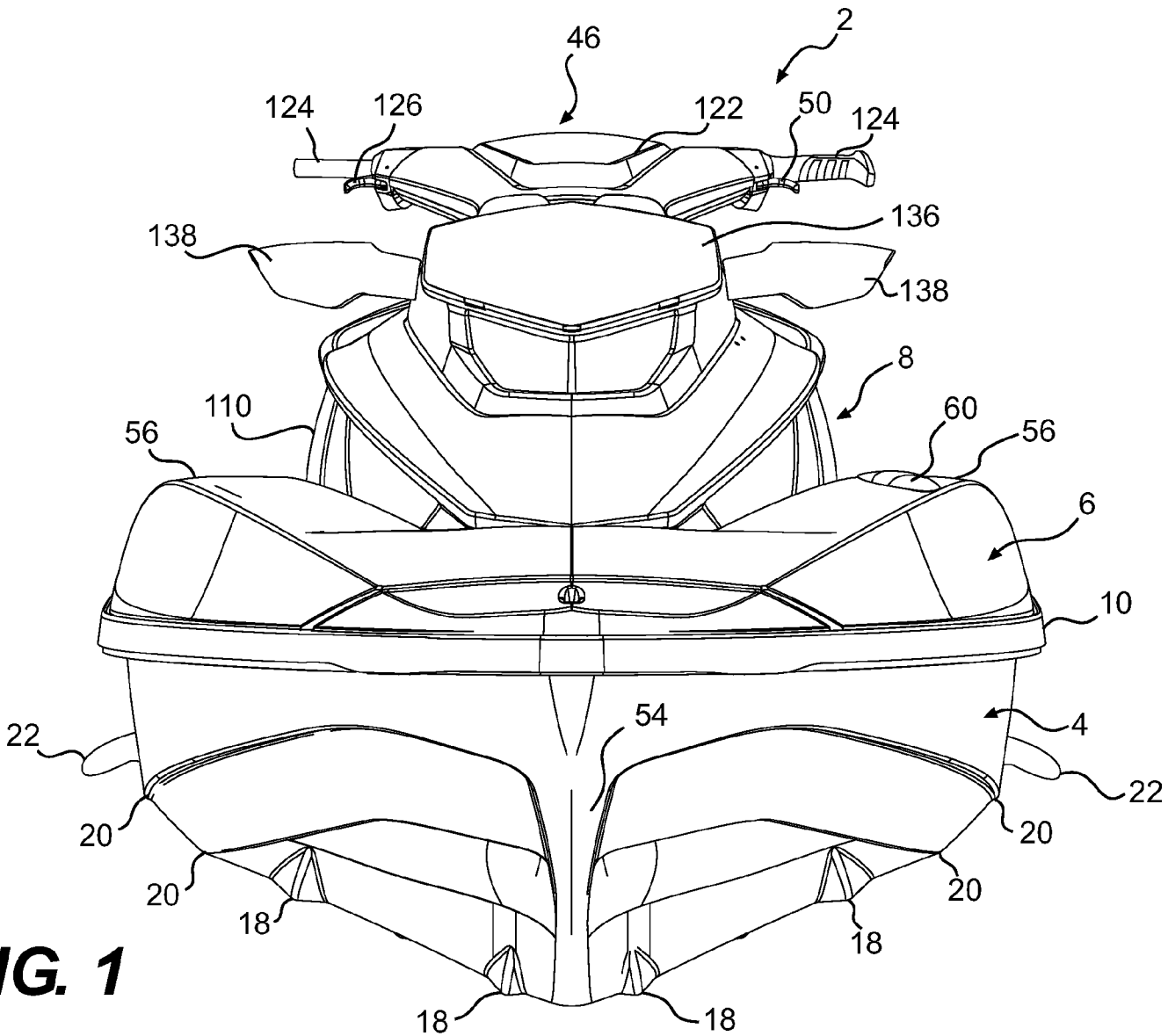
FIG. 1 is a front elevation view of a personal watercraft according to the present invention.

As best seen in FIGS. 1 and 6, the hull 4 is provided with a combination of strakes 18 and chines 20. A strake 18 is a protruding portion of the hull 4. A chine 20 is the vertex formed where two surfaces of the hull 4 meet. It is this combination of strakes 18 and chines 20 that will give, at least in part, the watercraft 2 its riding and handling characteristics.

Sponsons 22 are located on either side of the hull 4 near the transom 24. The sponsons 22 have an arcuate undersurface, which give the watercraft 2 both lift while in motion and improved turning characteristics.

Figure 2:
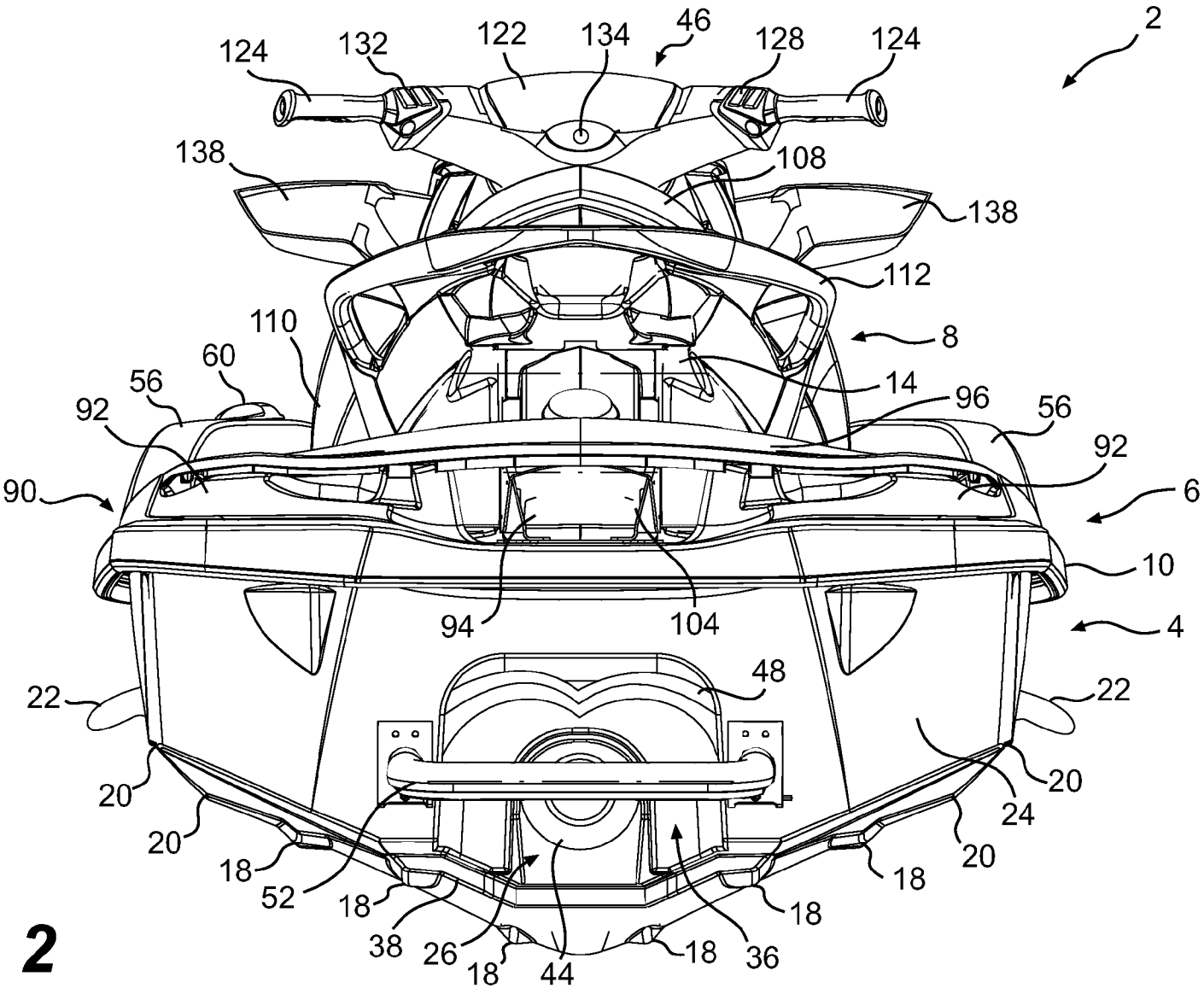
FIG. 2 is a rear elevation view of the watercraft of FIG. 1.
Figure 3:
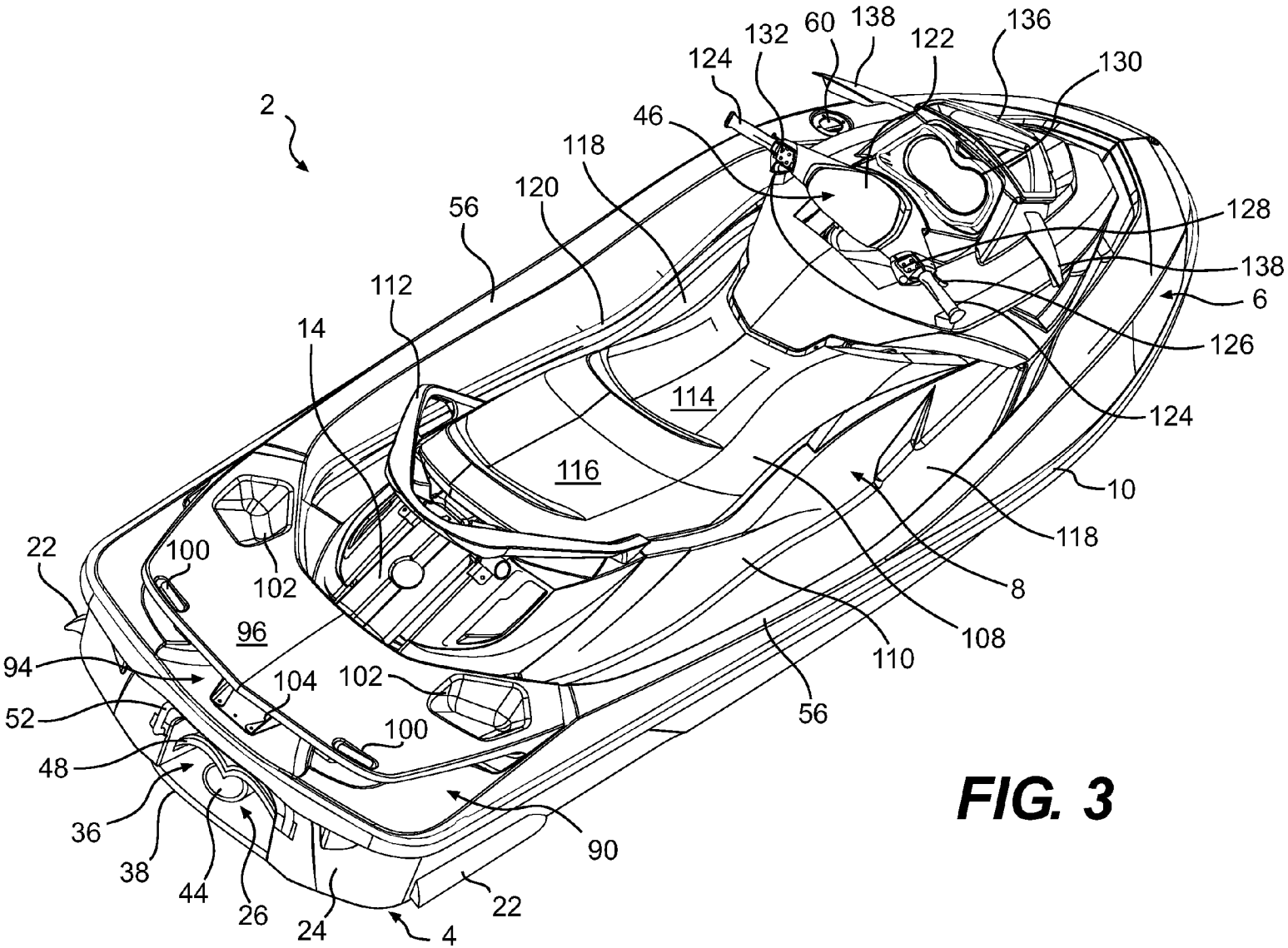
FIG. 3 is a perspective view, taken from a rear, right side, of the watercraft of FIG. 1.
Figure 4:
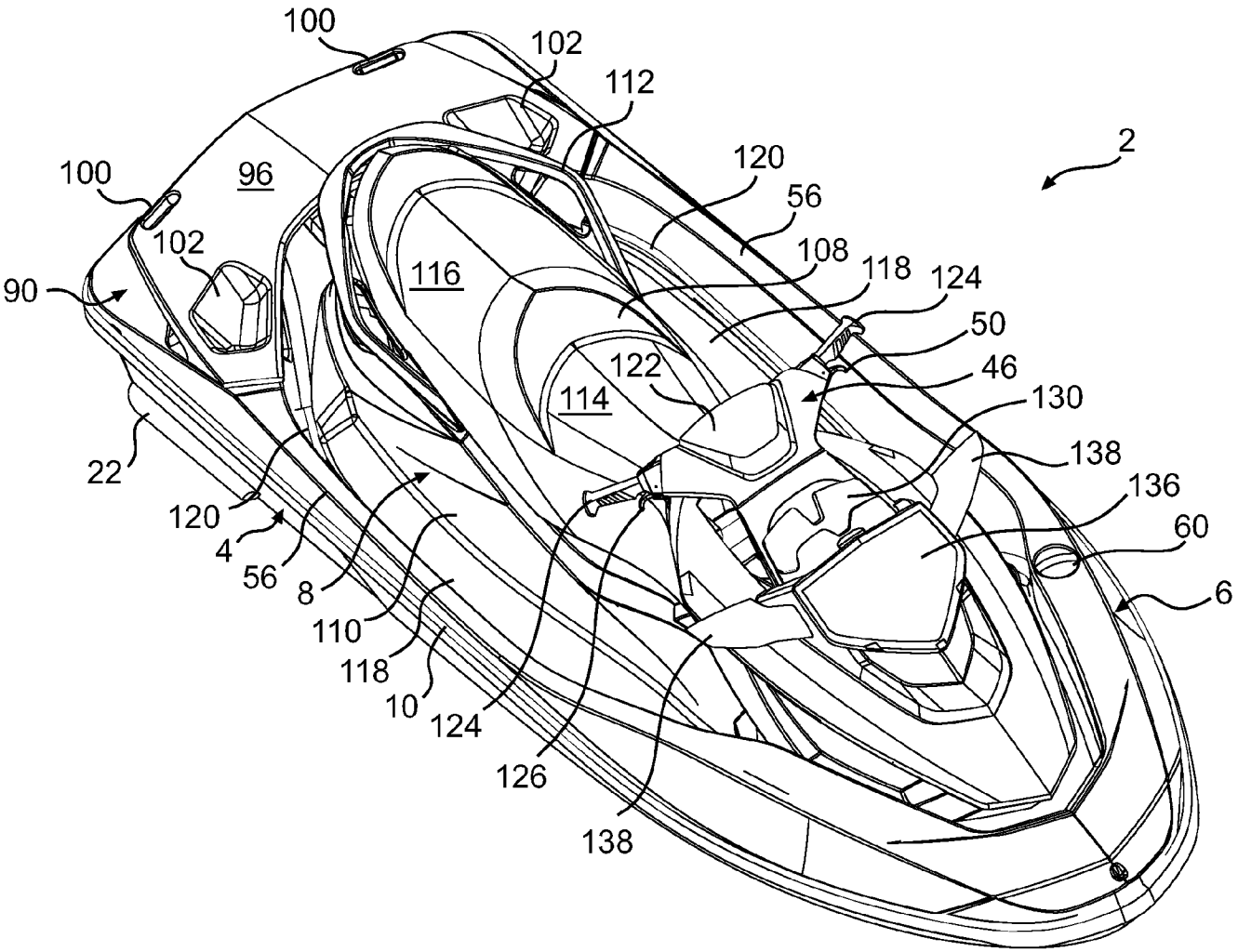
FIG. 4 is a perspective view, taken from a front, right side, of the water craft of FIG. 1.

As best seen in FIGS. 2 and 8, a jet propulsion system 26 is connected to the hull 4. The jet propulsion system 26 pressurizes water to create thrust. The water is first scooped from under the hull 4 through the inlet grate 28 (FIG. 6). The inlet grate 28 prevents large rocks, weeds, and other debris from entering the jet propulsion system 26 since they may otherwise damage it or negatively affect its performance. Water then flows through a water intake ramp 30. The top portion of the water intake ramp 30 is formed by hull 4 and a ride shoe 32 forms its bottom portion. Alternatively, the intake ramp 30 may be a single piece to which a jet pump unit 34 attaches. In such cases, the intake ramp 30 and the jet pump unit 34 are attached as a unit in a recess in the bottom of hull 4. From the intake ramp 30, water then enters the jet pump unit 34. The jet pump unit 34 is located in what is known as the tunnel 36. The tunnel 36 is opened towards the rear, is defined at the front, sides, and top by the hull 4, and at the bottom by a ride plate 38. The ride plate 38 is the surface on which the watercraft 2 rides or planes. The jet pump unit 34 includes an impeller and a stator (not shown) enclosed in a cylindrical housing. The impeller is coupled to the engine 12 by one or more shafts 40, such as a driveshaft and an impeller shaft. The rotation of the impeller pressurizes the water, which then moves over the stator that is made of a plurality of fixed stator blades (not shown). The role of the stator blades is to decrease the rotational motion of the water so that almost all the energy given to the water is used for thrust, as opposed to swirling the water. Once the water leaves the jet pump unit 34, it goes through the venturi 42. Since the venturi's exit diameter is smaller than its entrance diameter, the water is accelerated further, thereby providing more thrust. A steering nozzle 44 is pivotally attached to the venturi 42 about a vertical pivot axis. The steering nozzle 44 is operatively connected to a helm assembly 46 disposed on the deck 8 via a push-pull cable (not shown) such that when the helm assembly 46 is turned, the steering nozzle 44 pivots, redirecting the water coming from the venturi 42, so as to steer the watercraft 2 in the desired direction. It is contemplated that the steering nozzle 44 may be gimbaled to allow it to move about a second horizontal pivot axis (not shown). The up and down movement of the steering nozzle 44 provided by this additional pivot axis is known as trim, and controls the pitch of the watercraft 2. It is contemplated that other types of propulsion systems, such as a propeller, could be used.

A reverse gate 48 is pivotally attached to the sidewalls of the tunnel 36. It is contemplated that the reverse gate 48 could alternatively be pivotally attached to the venturi 42 or the steering nozzle 44. The reverse gate 48 is operatively connected to an electric motor (not shown) and the driver of the watercraft can control the position of the reverse gate 48 by pulling lever 50 (FIG. 1) located on the left side of the helm assembly 46 which is in electrical communication with the electric motor. It is contemplated that the reverse gate 48 could alternatively be mechanically connected to a reverse handle to be pulled by the driver. To make the watercraft 2 move in a reverse direction, the reverse gate 48 is pivoted in front of the steering nozzle 44 and redirects the water leaving the jet propulsion system 26 towards the front of the watercraft 2, thereby thrusting the watercraft 2 rearwardly.

A retractable ladder 52, best seen in FIG. 2 in its lowered position, is affixed to the transom to facilitate boarding 24 the watercraft 2 from the water.

Hooks (not shown) are located on the bow and transom 24 of the watercraft 2. These hooks are used to attach the watercraft 2 to a dock when the watercraft 2 is not in use or to a trailer when the watercraft 2 is being transported outside the water.

When the watercraft 2 is in movement, its speed is measured by a speed sensor (not shown) attached to the transom 24 of the watercraft 2. The speed sensor has a paddle wheel which is turned by the flow of water, therefore the faster the watercraft 2 goes, the faster the paddle wheel turns. An electronic control unit (not shown) connected to the speed sensor converts the rotational speed of the paddle wheel to the speed of the watercraft 2 in kilometers or miles per hour, depending on the driver's preference. The speed sensor may also be placed in the ride plate 38 or any other suitable position. Other types of speed sensors, such as pitot tubes, could also be used. It is also contemplated that the speed of the watercraft 2 could be determined from input from a GPS mounted to the watercraft 2.

Turning now to FIGS. 7 to 11, features of the sub-deck 6 will be described. The sub-deck 6 has a pair of generally upwardly extending walls located on either side thereof known as gunwales or gunnels 56. The gunnels 56 help to prevent the entry of water in the watercraft 2 and also provide buoyancy when turning the watercraft 2, since the watercraft 2 rolls slightly when turning. A refuelling opening 58 is provided on the front left gunnel 56. A hose (not shown) extends from the refuelling opening 58 to the fuel tank (not shown) disposed near the bow 54 in the volume formed between the hull 4 and the sub-deck 6. This arrangement allows for refilling of the fuel tank. A fuel cap 60 (FIG. 1) is used to sealingly close the refuelling opening 58, thereby preventing water from entering the fuel tank when the watercraft 2 is in use.

A pedestal 62 is centrally positioned on the sub-deck 6. The pedestal 62 accommodates the internal components of the watercraft 2, such as the engine 12, and shields these components from water. A portion of the rear of the pedestal 62, known as the engine cowling 64 (FIG. 9) can be removed to permit access to the engine 12. The engine cowling 64 is fastened to the remainder of the sub-deck 6 and a seal is disposed between the engine cowling 64 and the remainder of the sub-deck 6 to prevent water intrusion. The top portion of the engine cowling 64 is closed by a removable air intake unit 66. The air intake unit 66 is attached to the pedestal 62 by clips 67. The air intake unit 66 incorporates a system of arcuate passages and baffles which permit air to enter the volume between the hull 4 and the sub-deck 6, and thus be supplied to the engine 12, while reducing the likelihood of water entering that volume. Air enters around the sides of the air intake unit 66, goes through the passages and baffles therein, and then goes down a tube connected to the bottom of the air intake unit 66 and opening near the bottom of the hull 4. Removal of the air intake unit 66 permits access to elements located near the top of the engine 12 which need to be accessed more regularly, such as spark plugs (not shown) or the oil dipstick (not shown). A tow hook (not shown) is provided on the rear suspension arm 14 to provide an attachment point for towing a water-skier or an inflatable device for example.

An opening 68 is provided in a horizontal upper portion of the pedestal 62 forwardly of the engine cowling 64 to permit suspension elements 70 (FIG. 8) of the front suspension assembly 16 to pass therethrough. The suspension elements 70 absorb the loads as the HSD assembly moves relative to the deck 8 and dampen the motion. A bellows 72 (FIG. 8) is sealed around the opening 68 at a lower end thereof and is connected to the deck 8 at an upper end thereof to prevent water from entering the opening 68 while permitting relative movement between the sub-deck 6 and the deck 8. Two openings 74 are provided on generally vertical side walls of the pedestal 62 forwardly of the opening 68. As seen in FIGS. 8 and 9, these openings 74 allow a front suspension member of the front suspension assembly 16 to be pivotally connected to the deck 8. More specifically, the front suspension member includes a front suspension arm 76 and a shaft 78, and the upper end of the front suspension arm 76 is connected to the shaft 78 which extends through the openings 74 to pivotally connect to the deck 8. It is contemplated that the front suspension member could be made of a single part or that it could be made of more parts. Bellows 80 are sealingly connected to the sub-deck 6 around the openings 74 at one end thereof and are sealingly connected around brackets (not shown) that are attached to the shaft 78 at the other end thereof. The bellows 80 thus seal and prevent water from entering the openings 74 while permitting relative movement between the sub-deck 6 and the deck 8. Another opening 82 (best seen in FIG. 11) is located in the sub-deck 6 forwardly of the openings 74. Opening 82 allows the passage of two air intake tubes (not shown). Each intake tube has one end opened to a side of the pedestal 62 (one on each side), extends laterally to the other side of the pedestal 62, then moves down near the bottom of the hull 4, thus reducing the likelihood of water entering therethrough in case the watercraft 2 were to flip over. The deck 8 disposed on top of the sub-deck 6 also helps to prevent water from entering the various openings 68, 74, the air intake unit 66, and the air intake tubes by shielding them from direct exposure to water during normal operation. Should any water enter the volume between the hull 4 and the sub-deck 6, it will pool at the bottom of the hull 4 where it will be evacuated by a bilge system (not shown) as is know in the art.

As best seen in FIGS. 7 and 11, side channels 84 are formed between the gunnels 56 and the pedestal 62. The side channels 84 communicate with a recess 86 forward of the pedestal 62. The side channels 84 and the recess 86 receive the lower portions of the deck 8 and permit relative movement between the deck 8 and the sub-deck 6. Rubber mounts 88 (FIG. 7) are connected to the bottom of the side channels 84 to limit the relative movement of the sub-deck 6 towards the deck 8, and thus absorbing some of the impact should they come into contact.

A rear portion 90 of the sub-deck 6 is disposed higher than a bottom of the side channels 84. The rear portion 90 is high enough that, when the watercraft 2 is at rest and under normal loading conditions (i.e. no excess passengers or cargo), the rear portion 90 is disposed above the waterline thus preventing water from infiltrating into the side channels 84 from the back of the watercraft 2. The rear portion 90 has a raised portion on each side thereof forming storage compartments 92. The volume formed by the storage compartments 92 increases the buoyancy of the watercraft 2 and therefore, the lateral stability thereof. A rear channel 94 is formed between the two storage compartments 92. The rear channel 94 is disposed on a lateral center of the sub-deck 6 and its width is selected such that when the watercraft 2 turns (and therefore tilts) water will not enter the side channels 84 from the rear channel 94. When the watercraft 2 moves forward, the bow 54 raises, thus raising the side channels 84. This permits any water accumulated in the side channels 84 to drain through the rear channel 94.

Figure 12:
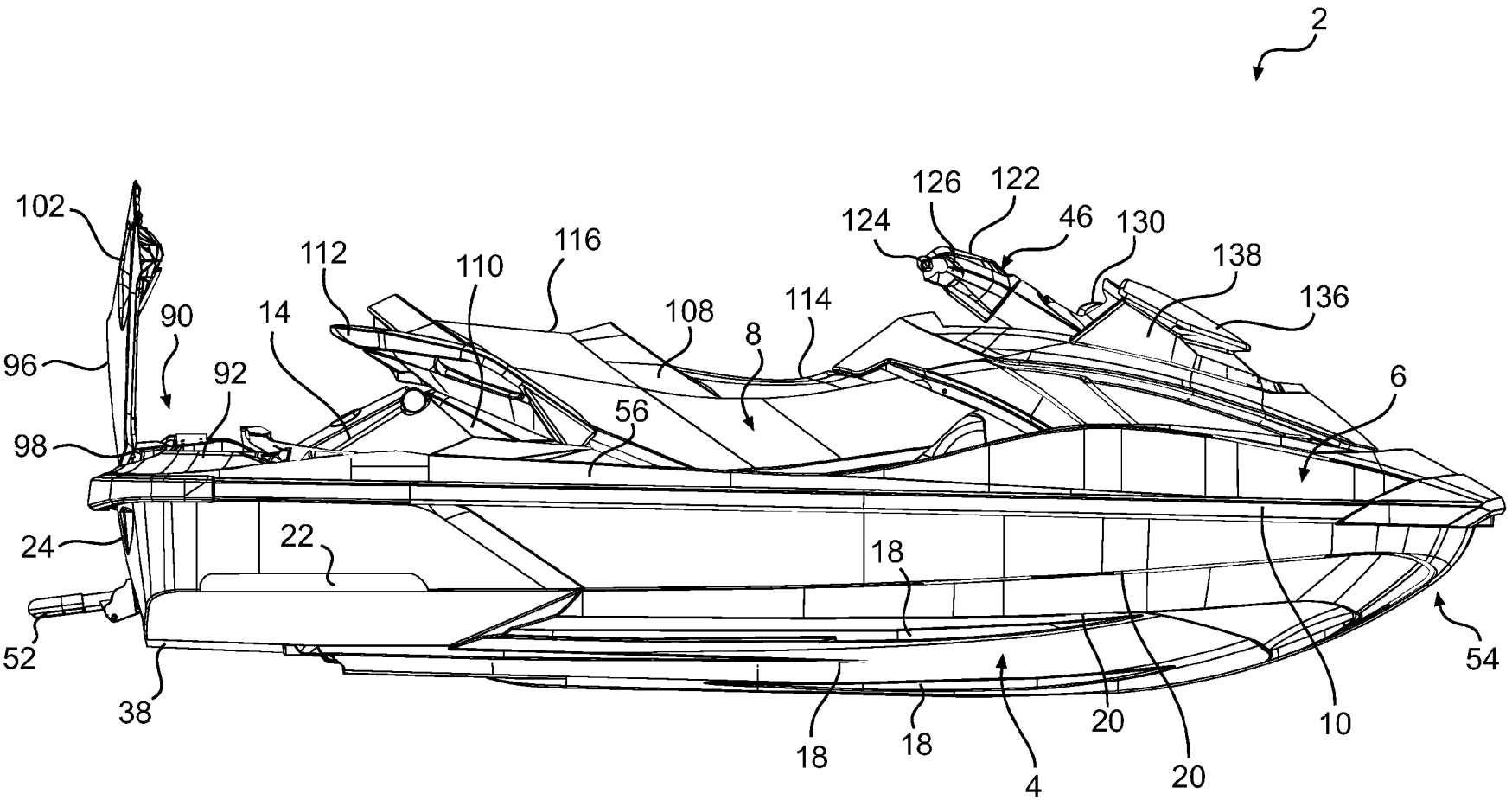
FIG. 12 is a side elevation view of the watercraft of FIG. 1 with a rear platform thereof in a raised position.

A rear platform 96 is pivotally connected on the rear portion 90 of the sub-deck 6. The platform 96 preferably pivots about an axis 98 (FIGS. 5 and 12) located near the transom 24 and extending laterally across the sub-deck 6. It is contemplated that the platform 96 could alternatively pivot about an axis located near the front of thereof and extending laterally across the sub-deck 6. It is also contemplated that the platform 96 could alternatively pivot about an axis extending generally parallel to a longitudinal axis of the watercraft 2 and disposed near a lateral side of the platform 96. When the rear platform 96 is in a raised position, as shown in FIG. 12, it permits access to the storage compartments 92. When the rear platform 96 is in a lowered, horizontal position, as shown in FIGS. 2 to 5, the rear platform 96 closes and seals the storage compartments 92, thus eliminating the need of separate lids to accomplish this function. In the lowered position, the rear platform 96 provides a surface on which the driver or passengers can stand when the watercraft 2 is at rest. Two recesses in the rear platform 96 form hand grips 100 which a person can grab to assist themselves when reboarding the watercraft 2 from the water. Two more recesses in the rear platform 96 form heel rests 102 which a passenger sitting on the watercraft 2 facing rearwardly, for spotting a water-skier being towed by the watercraft 2 for example, can use to place their heels to provide them with additional stability. Carpeting made of a rubber-type material preferably covers the rear platform 96 to provide additional comfort and feet traction on the rear platform 96.

Turning back to FIGS. 1 to 8, the deck 8 of the watercraft 2 will be described. As previously mentioned, the deck 8 is suspended on the HSD assembly. As seen in FIG. 8, the rear portion of the deck 8 is pivotally connected to the upper end of the rear suspension arm 14. The rear suspension arm 14 extends downwardly and rearwardly from its connection to the rear portion of the deck 8 and the lower end of the rear suspension arm 14 pivotally connects to a bracket 104 on the rear portion 90 of the sub-deck 6. It is contemplated that the bracket 104 could be disposed inside the volume between the hull 4 and the sub-deck 6, with the addition of an opening in the rear portion 90 of the sub-deck 6 and of a bellows similar to bellows 80 extending between the opening and the rear suspension arm 14 to prevent the intrusion of water in the watercraft 2. The front portion of the deck 8 is connected to the front suspension assembly 16. The front portion of the deck 8 is connected, via shaft 78, to the upper end of the front suspension arm 76. The front suspension arm 76 extends downwardly and rearwardly from its connection to the front portion of the deck 8 and the lower end of the front suspension arm 76 pivotally connects to the hull 4 via a bracket 106 on the bottom of the hull 4. It is contemplated that the lower end of the front suspension arm 76 could be pivotally connected to the sub-deck 6 via a bracket mounted inside the sub-deck 6. Suspension elements 70 are connected at their lower ends to the front suspension arm 76 forwardly of and near to the bracket 106. From there, the suspension elements 70 extend vertically upwardly to connect to the under side of the deck 8 at their upper ends such that a longitudinal centerline 71 (FIG. 8) of the suspension elements 70 extends through a point located longitudinally between the helm assembly 46 and the longitudinal center of a straddle-type seat 108 (discussed below). The force absorption characteristics of the suspension elements 70 can be adjusted by the driver of the watercraft 2 to take into account the load on the deck 8 (i.e. the presence or absence of passengers and/or cargo) and/or to change the riding characteristics of the watercraft 2. The geometry of the rear and front suspension arms 14, 76 is such that as the watercraft 2 moves on the water, the HSD assembly will move rearwardly and upwardly relative to the deck 8 as it encounters waves, thus absorbing the impact thereby providing a more comfortable ride for the driver and passengers, if applicable, since the deck 8 will be more stable.

As seen in FIGS. 1 to 5, the deck has a centrally positioned straddle-type seat 108 placed on top of a pedestal 110 to accommodate the driver and passengers in a straddling position. A grab handle 112 is provided between the pedestal 110 and the straddle-type seat 108 at the rear of the straddle-type seat 108 to provide a handle onto which a passenger may hold on. The straddle-type seat 108 has a first seat portion 114 to accommodate the driver and second seat portion 116 to accommodate one or two passengers. The seat 108 is pivotally connected to the pedestal 110 at the front thereof by a system of linkages and is connected at the rear thereof by a latch assembly (not shown). The seat 108 selectively covers an opening (not shown), defined by a top portion of the pedestal 110, which provides access to the air intake unit 66, which once removed, provides access to the upper portion of the engine 12.

Located on either side of the pedestal 110, between the pedestal 110 and the gunnels 56 of the sub-deck 6, are a pair of generally horizontal footrests 118 disposed vertically lower than an upper end of the gunnels 56 designed to accommodate the driver's and passengers' feet. By having the footrests 118 form part of the deck 8, the legs of the driver and passengers are not moving with the HSD assembly, and therefore the driver's and passengers' legs are not solicited to absorb part of the impact between the watercraft 2 and the waves. As best seen in FIGS. 5 and 7, a seal 120 is disposed between each footrest 118 and its corresponding gunnel 56 on the sub-deck 6. The seals 120 do not need to make the space between the footrests 118 and the gunnels 56 watertight since any water that enters in the side channels 84 located below can be evacuated through the rear channel 94. The seals 120 are there to prevent objects from falling through that space and then falling in the side channels 84, which would make these objects difficult to recover without removing the deck 8. Since an upper end of the side channels 84 is wider than a lower end of the side channels 84, the seals 120 are preferably made of a flexible material, such as rubber or plastic, that can compress and expand to follow the inner side of the gunnels 56 as the HSD assembly moves relative to the deck 8. The footrests 118 are preferably covered by carpeting made of a rubber-type material to provide additional comfort and feet traction.

As best seen in FIGS. 2 and 5, the helm assembly 46 is positioned forwardly of the straddle-type seat 108. As previously mentioned, the helm assembly 46 is used to turn the steering nozzle 44, and therefore the watercraft 2. The helm assembly 46 has a central helm portion 122 that may be padded, and a pair of steering handles 124. The right steering handle 124 is provided with a throttle lever 126 allowing the driver to control the speed of the watercraft 2. The left steering handle is provided with a lever 50 to control the position of the reverse gate 48, as previously mentioned. The central helm portion 122 has buttons 128 that allow the driver to modify what is displayed (such as speed, engine rpm, and time) on the display cluster 130 located forwardly of the helm assembly 46. Additional switches in the form of buttons 132 are provided on the helm portion 122 to allow the driver to adjust the force absorption characteristics of the suspension elements 70. The helm assembly 46 is also provided with a key receiving post 134 near a center thereof. The key receiving post 134 is adapted to receive a key (not shown) attached to a lanyard (not shown) so as to allow starting of the watercraft 2. It should be noted that the key receiving post 134 may alternatively be placed in any suitable location on the watercraft 2. The helm assembly 46 is preferably pivotable about a horizontal axis to allow the height of the helm assembly 46 to be adjusted to suit the driver's preference. The display cluster 130 also preferably moves about the horizontal axis with the helm assembly 46.

The deck 8 is provided with a hood 136 located forwardly of the helm assembly 46. A hinge (not shown) is attached between a forward portion of the hood 136 and the deck 8 to allow hood 136 to move to an opened position to provide access to a front storage bin (not shown). A latch (not shown) located at a rearward portion of hood 136 locks hood 136 into a closed position. When in the closed position, hood 136 prevents access to the front storage bin. Rearview mirrors 138 are positioned on either side of hood 136 to allow the driver to see behind the watercraft 2 while driving.

Figure 13:
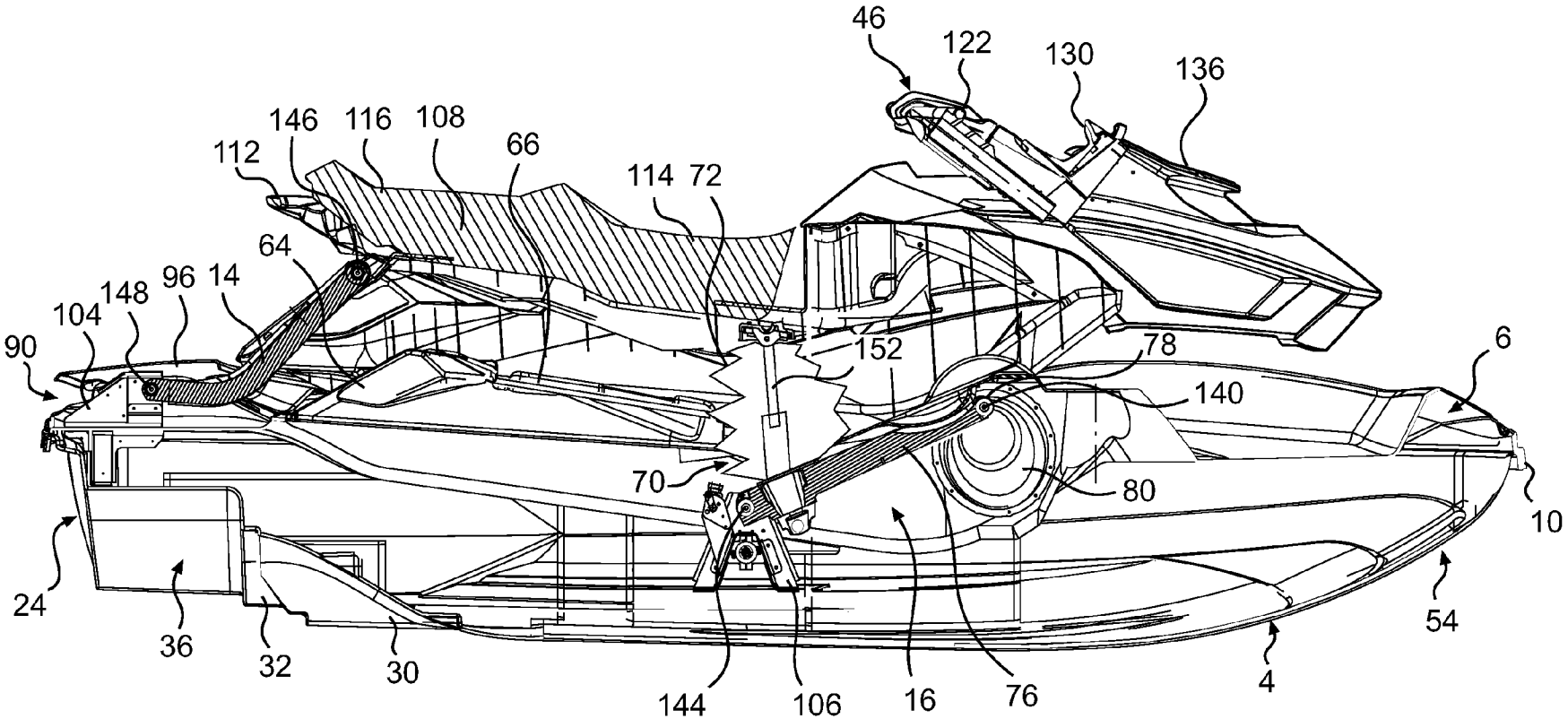
FIG. 13 is a partial longitudinal cross-section of the watercraft of FIG. 1 showing the hull and sub-deck assembly in a first position relative to the deck.
Figure 14:
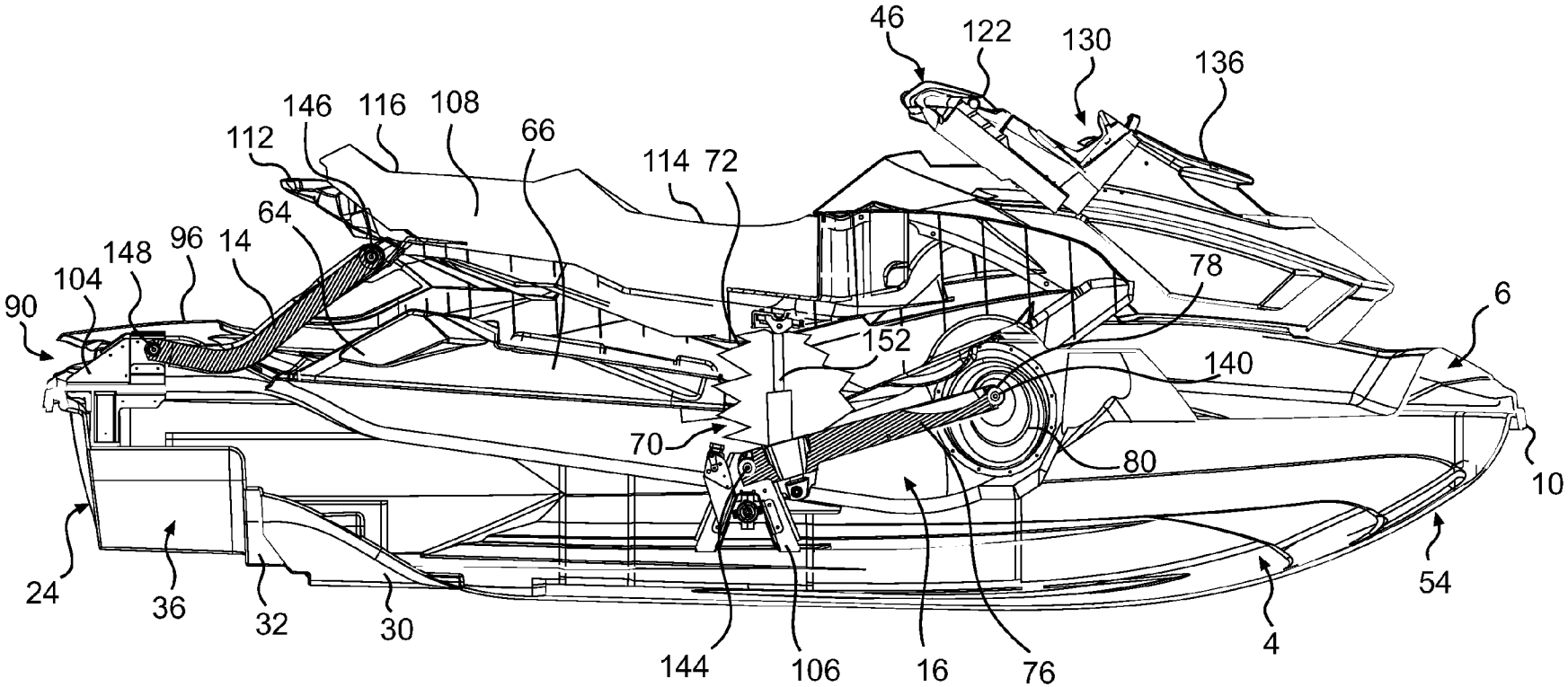
FIG. 14 is a partial longitudinal cross-section of the watercraft of FIG. 1 showing the hull and sub-deck assembly in a second position relative to the deck.
Figure 15:
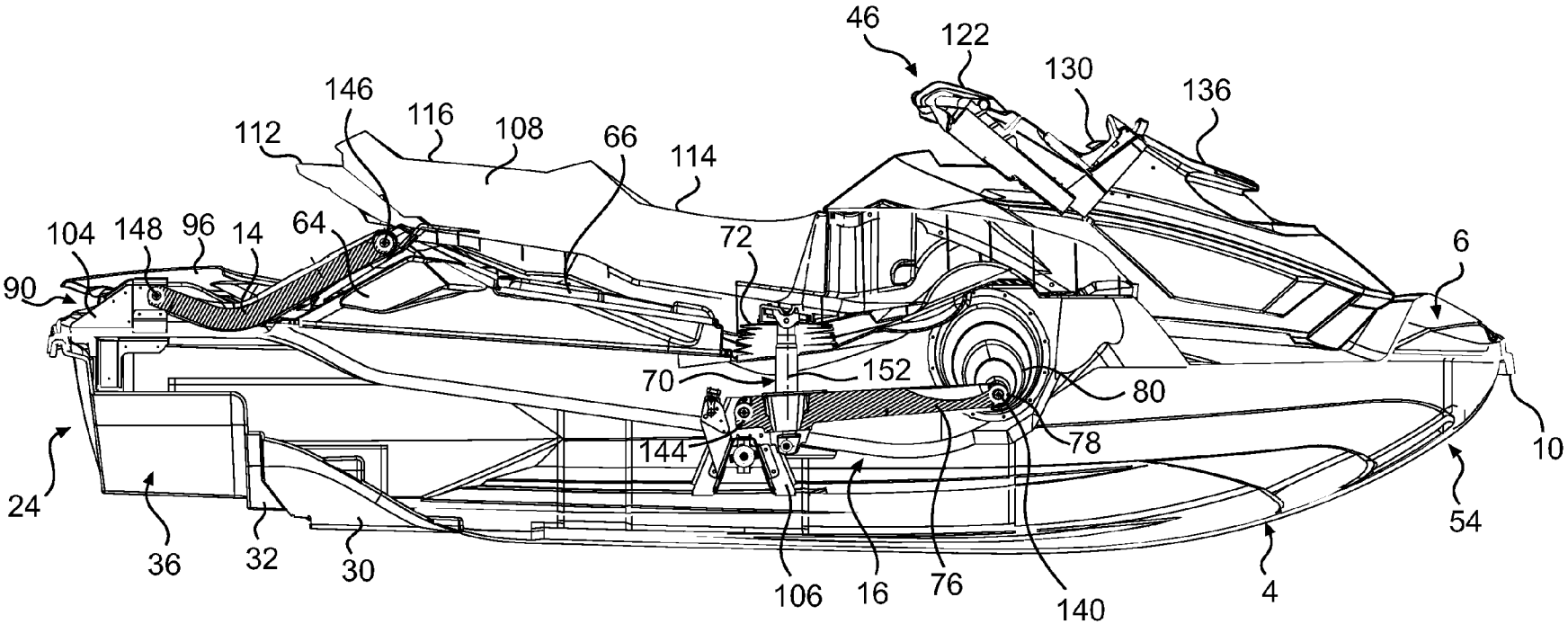
FIG. 15 is a partial longitudinal cross-section of the watercraft of FIG. 1 showing the hull and sub-deck assembly in a third position relative to the deck.

The suspension of the watercraft 2 will now be described in greater detail. As previously mentioned, and as illustrated in FIGS. 13 to 15, the HSD assembly is movable relative to the deck 8 since the HSD assembly is pivotally connected to the deck 8 via rear suspension arm 14 and front suspension assembly 16. As seen in FIG. 8, the front suspension arm 76 is disposed forwardly of the engine 12. The upper end of the front suspension arm 76 is pivotally connected to the deck 8 about a first pivot axis 140. The first pivot axis 140 corresponds to an axis of the shaft 78. Brackets 142 (FIG. 16) are connected to the ends of the shaft 78 and the deck 8 is fastened to the brackets 142. The lower end of the front suspension arm 76 is pivotally connected to the HSD assembly, more specifically the bracket 106 in the hull 4, about a second pivot axis 144. The rear suspension arm 14 is disposed at least in part rearwardly of the engine 12. The upper end of the rear suspension arm 14 is pivotally connected to the deck 8 about a third pivot axis 146 The lower end of the rear suspension arm 14 is pivotally connected to the HSD assembly, more specifically the bracket 104 sub-deck 6, about a fourth pivot axis 142.

As can also be seen in FIG. 8, the second pivot axis 144 is disposed rearwardly and downwardly of the first pivot axis 140, and rearwardly of the helm assembly 46. The third pivot axis 146 is disposed rearwardly of the second pivot axis 144. The fourth pivot axis 148 is disposed rearwardly and downwardly of the third pivot axis 146. The first pivot axis 140 is disposed downwardly of the third pivot axis 146. The distance between the first and second pivot axes 140, 144 is fixed. The distance between the third and fourth pivot axes 146,148 is fixed. The distance between the first and third pivot axes 140, 146 is fixed. The distance between the second and fourth pivot axes 144, 148 is fixed. Also, the distance between the first and second pivot axes 140, 144 is greater than the distance between the third and fourth pivot axes 146, 148.

Figure 17:
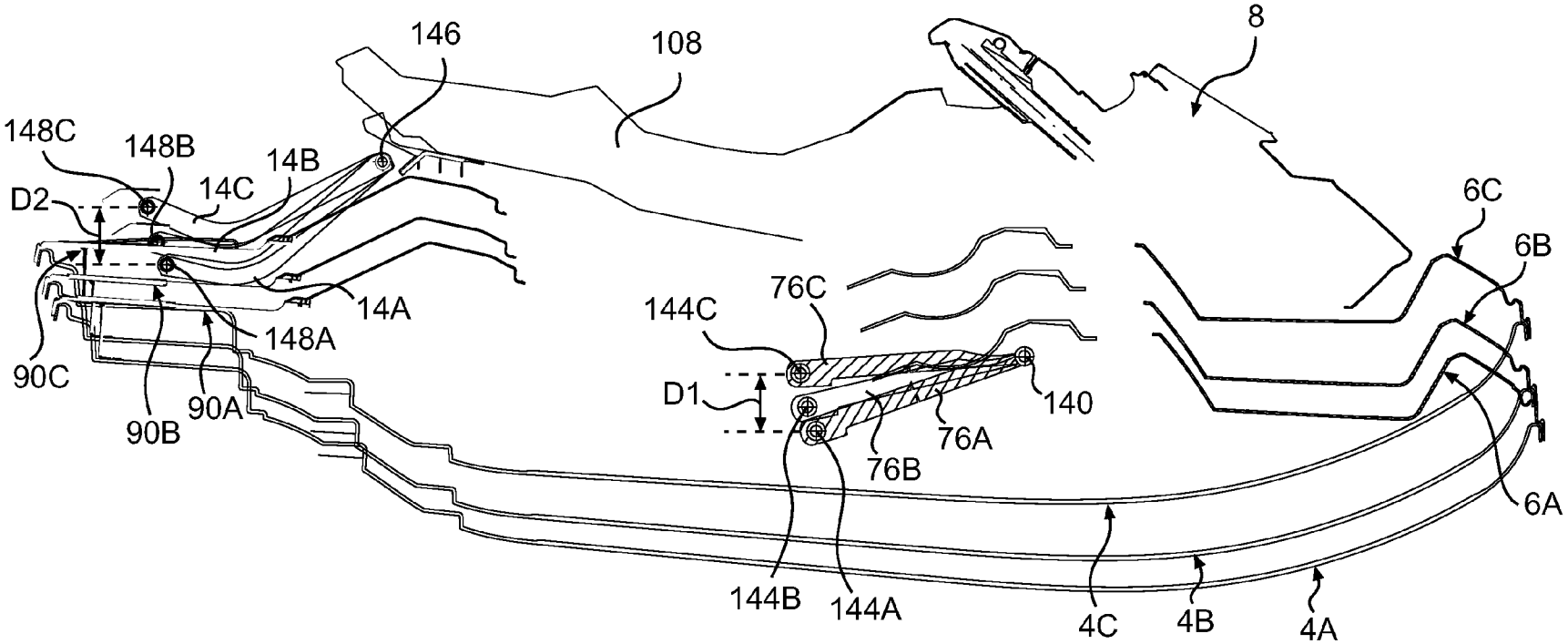
FIG. 17 is schematic representation of the watercraft showing the positions of the hull and sub-deck assembly in FIGS. 13, 14, and 15 relative to each other.

When the suspension elements 70 are not or are only slightly compressed, the HSD assembly and deck 8 are as shown in FIG. 13. As the suspension elements 70 become compressed, the HSD assembly and the deck 8 come closer together and are as shown in FIG. 14. As the suspension elements 70 become even more compressed, the HSD assembly and deck 8 are even closer together and are as shown in FIG. 15. By overlapping the outlines of some of the components of the watercraft 2 in these various positions, as shown in FIG. 17, the motion of the HSD assembly relative to the deck 8 can be more easily understood. In FIG. 17, the elements corresponding to the position shown in FIG. 13 have been labelled with the letter A following their reference numbers. Similarly, the letters B and C have been used for the positions shown in FIGS. 14 and 15 respectively. It can be seen that the geometry described above results in the HSD assembly moving upwardly and rearwardly relative to the deck 8 when the suspension elements 70 become compressed, such as when the hull 4 impacts a wave for example. The second and fourth pivot axes 144, 148 both move upwardly and rearwardly from their positions 144A, 148A toward their positions 144C, 148C. It can also be seen that the vertical distance D1 from the position 144A of second pivot axis 144 to the position 144C of the second pivot axis 144 is greater distance than the vertical distance D2 from the position 148A of fourth pivot axis 148 to the position 148C of the fourth pivot axis 144. This results in the bow 54 of the hull 4 moving upwardly toward the deck 8 by a greater amount than the transom 24.

FIGS. 13 to 15 also show that the bellows 72 expands and contracts as the HSD assembly moves relative to the deck 8. Similarly, the bellows 80 disposed around the shaft 78 move relative to the shaft 78 as the HSD assembly moves relative to the deck 8. Thus, the bellows 72, 80 prevent the entry of water inside the HSD assembly as the HSD assembly moves relative to the deck 8.

As previously mentioned, the watercraft 2 has suspension elements 70 which are pivotally connected at one end to the deck 8, pass through the opening 68, and are pivotally connected to the front suspension arm 76 at the other end. The suspension elements 70 extend generally vertically. The upper end of the suspension elements 70 are connected to a plate 150 (FIG. 16) around which the upper end of the bellows 72 is also connected. It is contemplated that in at least some embodiments, the suspension elements 70 could be connected between the deck 8 and the sub-deck 6, the deck 8 and the hull 4, the deck 8 and the rear suspension arm 14, the sub-deck 6 and the front suspension arm 76, the sub-deck 6 and the rear suspension arm 14, the sub-deck 6 and the front suspension arm 76, the hull 4 and the front suspension arm 76, or the hull 4 and the rear suspension arm 14.

Figure 18:
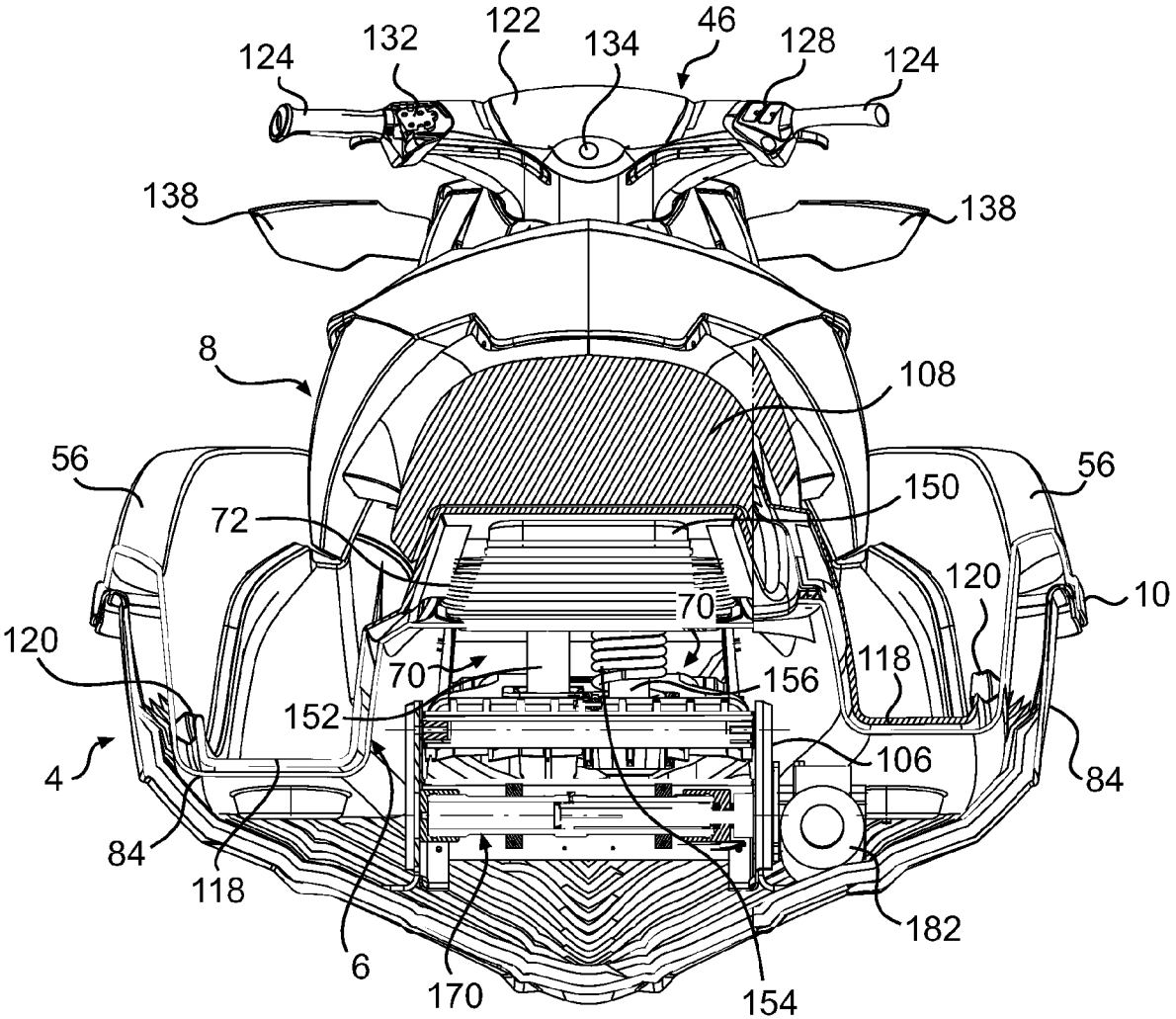
FIG. 18 is a transverse cross-section of the watercraft of FIG. 1 showing components of the suspension.

As seen in FIG. 18, the watercraft 2 has two suspension elements 70. The first is a hydraulic damper 152 to dampen the movement of the HSD assembly relative to the deck 8. The hydraulic damper 152 is preferably a dual rate damper, which means that the damping rate is a first damping rate for one range of positions of the damper 152 and is a second damping rate for another range of positions of the damper 152. The second is a spring assembly 154 to position the HSD assembly relative to the deck 8. The second suspension element also includes a lifting device 156 used to change the initial position of the deck 8 relative to the HSD assembly and/or to pre-load the spring assembly 154, as discussed in greater detail below. It is contemplated that a single suspension element combining the features of both suspension elements 70 could be used. Both suspension elements 70 are parallel to each other and are disposed next to each other.

Figure 16:
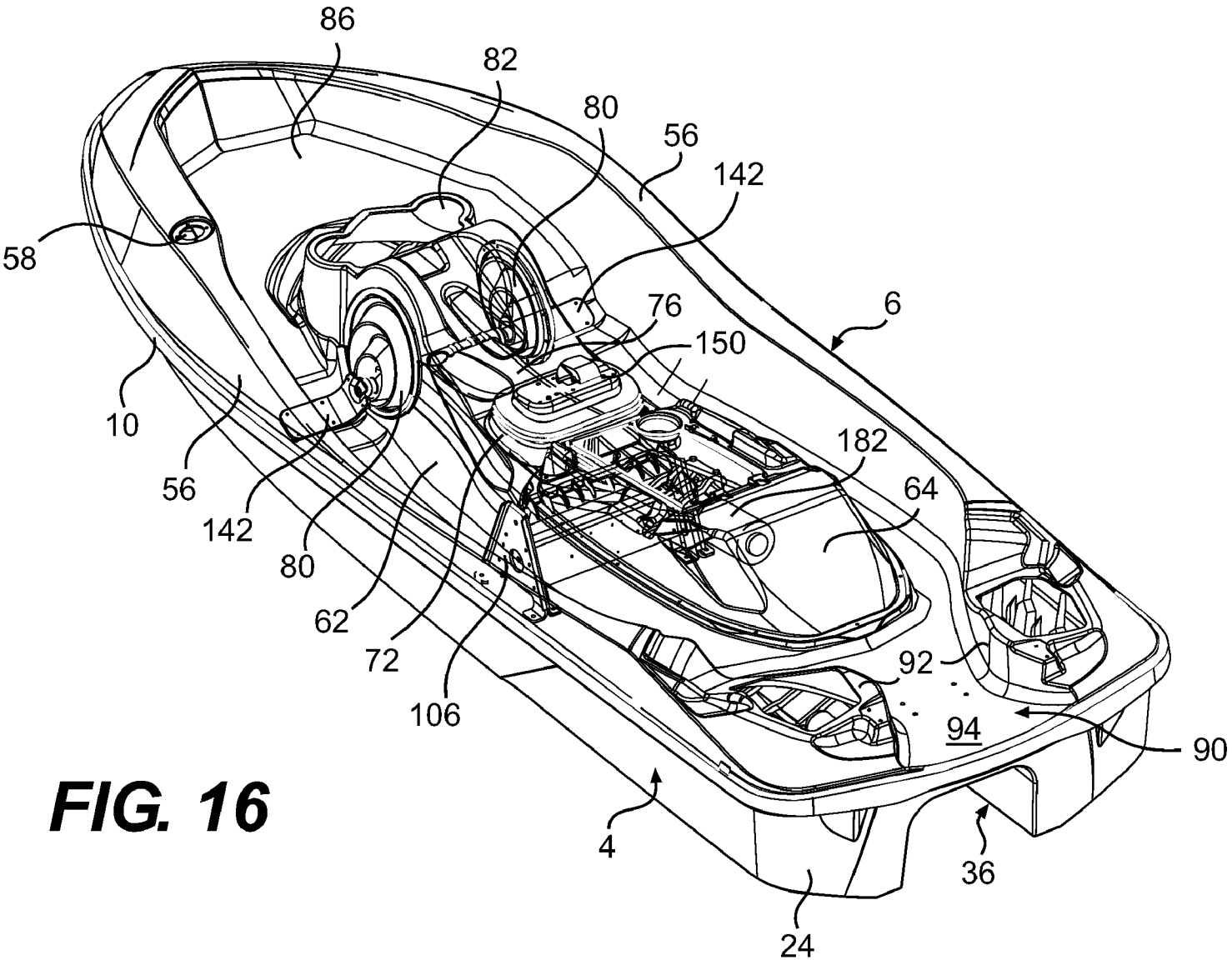
FIG. 16 is a perspective view, taken from a rear, left side, of the hull and sub-deck assembly with portions of the sub-deck in transparency to show some of the internal elements of the watercraft.
Figure 19:
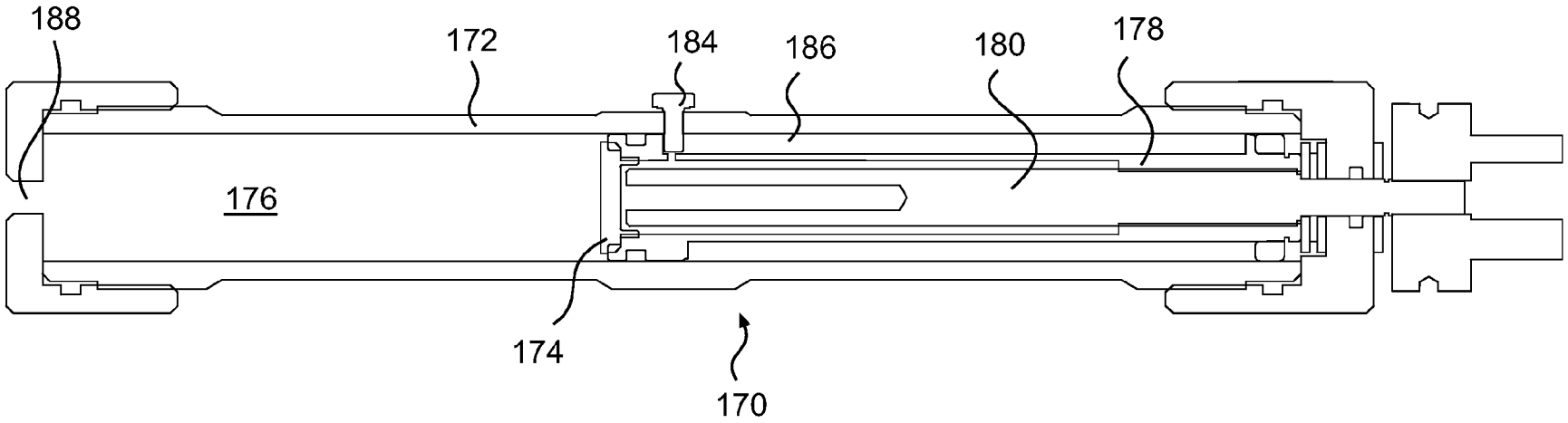
FIG. 19 is a cross-section of a hydraulic cylinder of the watercraft of FIG. 1 with a piston thereof in a first position.
Figure 22:
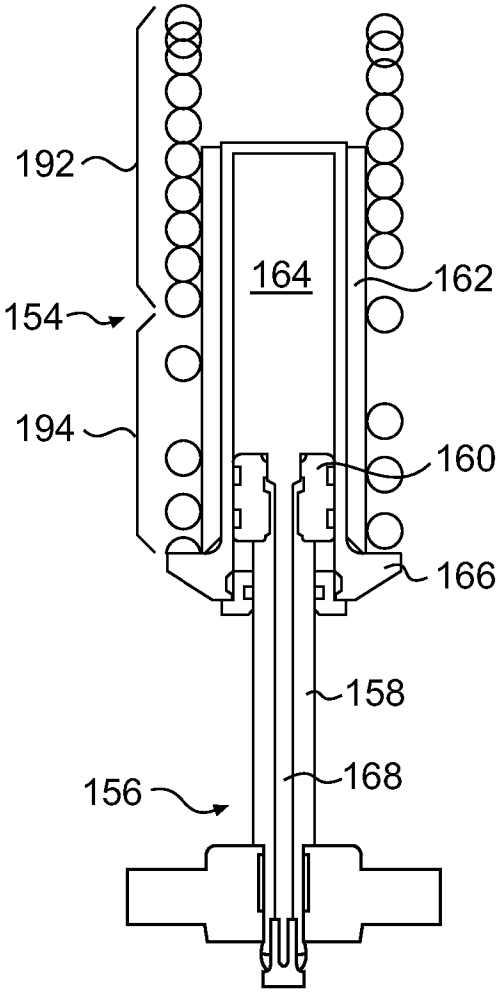
FIG. 22 is a cross-section of the lifting device and spring assembly of FIG. 20 with the housing of the spring assembly in a second position.
Figure 20:
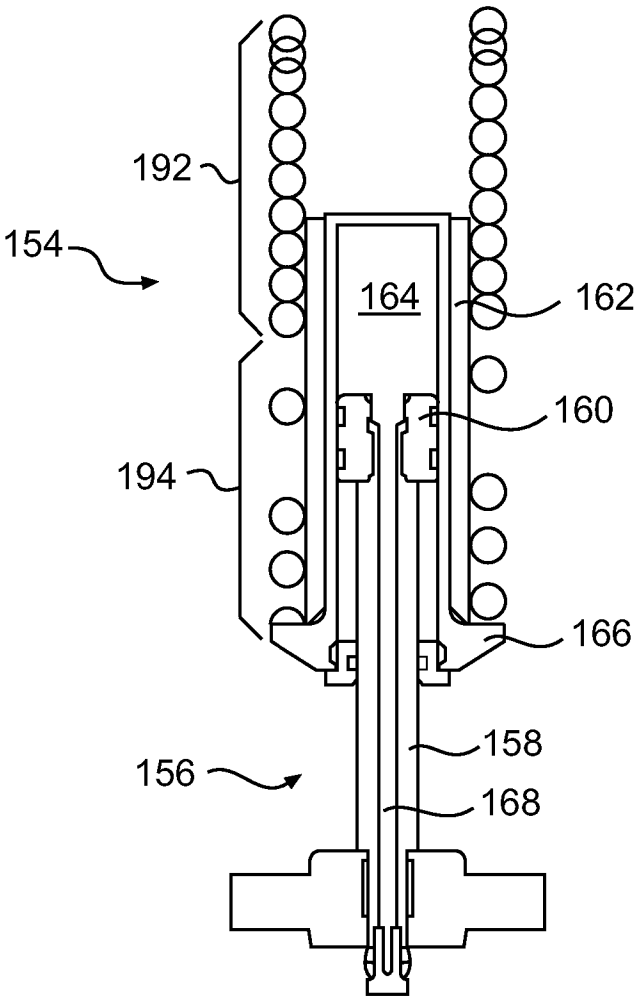
FIG. 20 is a cross-section of a lifting device and spring assembly of the watercraft of FIG. 1 with the housing of the spring assembly in a first position.
Figure 21:
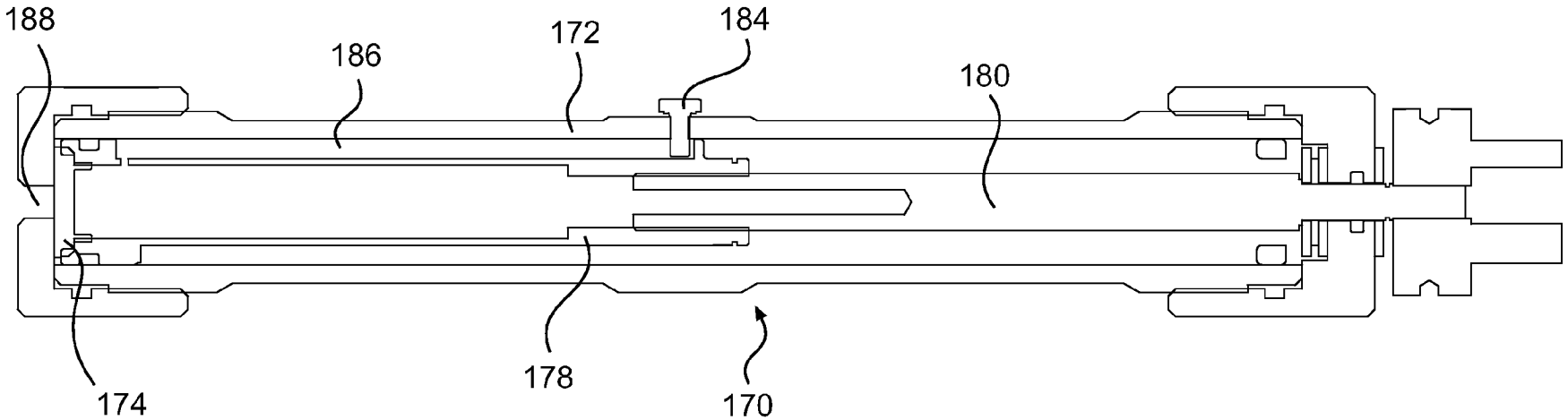
FIG. 21 is a cross-section of the hydraulic cylinder of FIG. 19 with the piston in a second position.
Figure 24B:
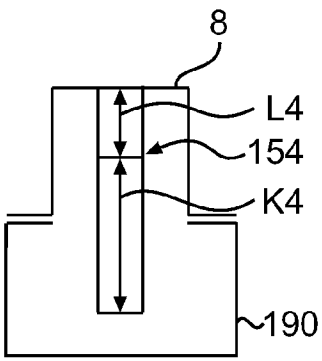

As seen in FIGS. 20 and 22 the lifting device 156 has piston rod 158 with a piston 160 at one end thereof. A housing 162 of the lifting device 156 is disposed around the piston 160 and is slidable relative to the piston 160. A first chamber 164 having an adjustable volume is formed between the piston 160 and the housing 162. The spring assembly 154 is disposed in part around the housing 162 and sits on a flange 166 extending outwardly from the housing 162. As seen in FIG. 8, the lower end of the piston rod 158 is pivotally connected to the front suspension arm 76 and the upper end of the spring assembly 154 is connected to the deck 8. Returning to FIGS. 20 and 22, the piston rod 158 has a passage 168 therein for allowing hydraulic fluid to enter or exit the first chamber 164. A hose (not shown) fluidly communicates the passage 168 with a hydraulic cylinder 170 (FIG. 18) mounted to bracket 106. As seen in FIG. 19 and 21, the hydraulic cylinder 170 has a cylinder housing 172 and a piston 174 disposed in the cylinder housing 172. A second chamber 176 having an adjustable volume is formed between the cylinder housing 172 and the piston 174. A piston rod 178 having internal threads is connected to the piston 174. A threaded rod 180 having external threads is disposed inside the piston rod 178. An end of the threaded rod 180 extends outside the cylinder housing 172 and is connected to an electric motor 182 (FIGS. 16 and 18). The electric motor 182 is used to turn the threaded rod 180. A pin 184 inserted in the cylinder housing 172 fits in a key 186 in the piston rod 178, thus preventing the piston rod 178 to rotate with the threaded rod 180, which results in the piston rod 178, and therefore the piston 174, moving linearly inside the cylinder housing 172. When the piston 174 is in the position shown in FIG. 19, the lifting device 156 is in the position shown in FIG. 20. When the piston 174 is moved to the position shown in FIG. 21, the volume of the second chamber 176 is reduced causing hydraulic fluid to exit the hydraulic cylinder 170 through an opening 188 in the cylinder housing, to pass through the hose, to enter the passage 168, and to enter the first chamber 164. The fluid entering the first chamber 164 causes the volume of the first chamber 164 to increase, causing the housing 162 to move up. By moving up, the housing 164 lifts the spring assembly 154, thus raising the deck 8 (when the watercraft 2 is static, the load on the deck remains the same, and the deck 8 has not reached its topped-out position, as discussed in greater detail below). When the piston 174 is moved back to the position shown in FIG. 19, the hydraulic fluid moves in the opposite direction due to the weight of the deck 8 pushing on the spring assembly 154, the housing 162 moves back to the position shown in FIG. 20, and the spring assembly 154 and deck 8 move back down. It is contemplated that other types of lifting devices could be used.

Figure 28:
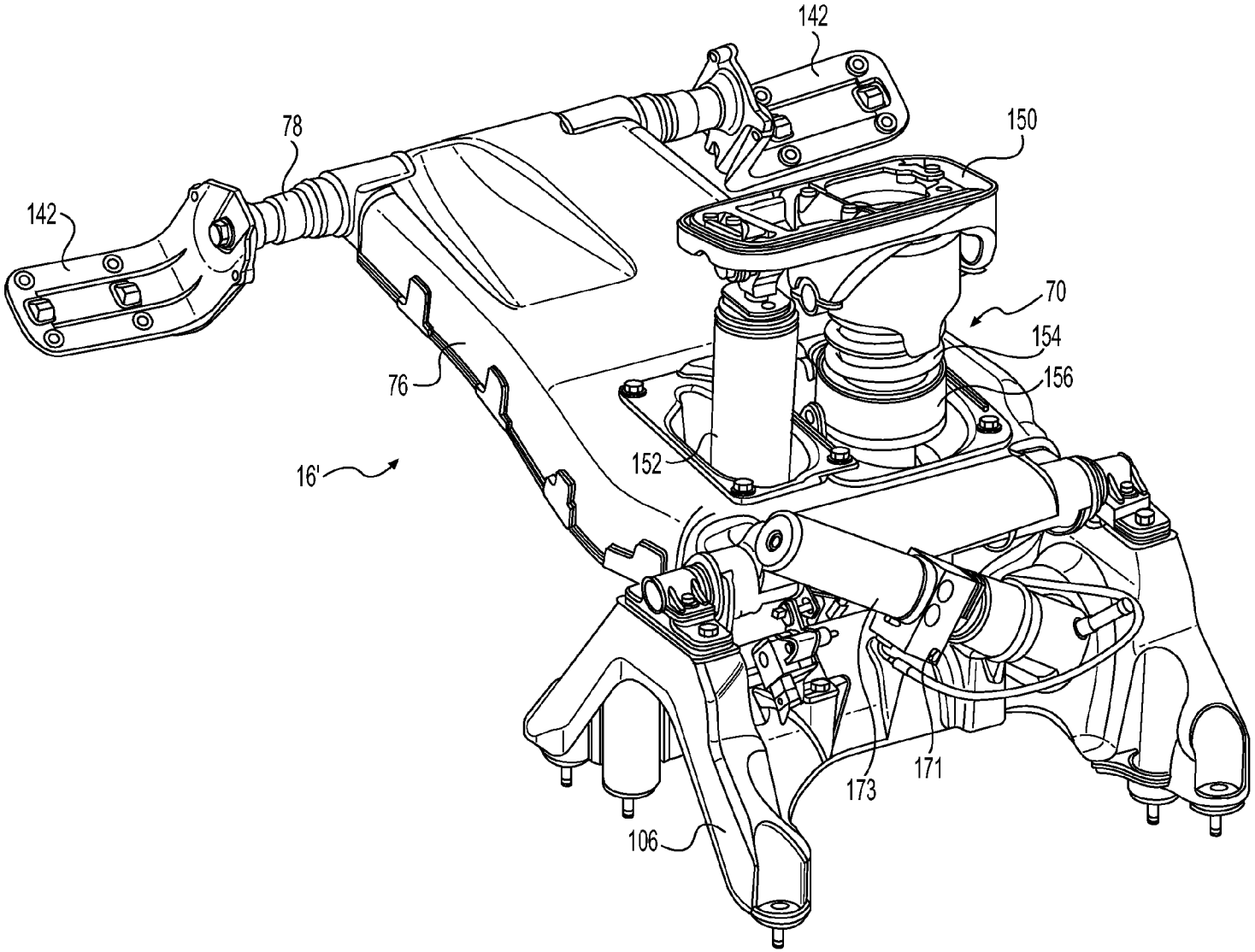
FIG. 28 is a perspective view taken from a rear, left side, of an alternative embodiment of a front suspension assembly.

FIG. 28 illustrates an alternative embodiment of the front suspension assembly 16 (i.e. front suspension assembly 16'). For simplicity, like elements have been labelled with the same reference numerals and will not be described again. In the front suspension assembly 16', the hydraulic cylinder 170 and the electric motor 182 have been replaced by an hydraulic pump 171 and a hydraulic fluid reservoir 173. The hydraulic pump 171 is supported by the bracket 106 and the hydraulic fluid reservoir 173 is mounted to the end of the hydraulic pump 171. To cause the housing 162 of the lifting device 156 to move up, the electrically powered hydraulic pump 171 pumps hydraulic fluid from the hydraulic reservoir 173 to the chamber 164 of the lifting device 156. To cause the housing 162 of the lifting device 156 to move down, the hydraulic pump 171 pumps hydraulic fluid from the chamber 164 of the lifting device 156 to the hydraulic reservoir 173.

As seen in FIGS. 20 and 22, the spring assembly 154 is a dual rate coil spring that has two portions 192, 194. The first portion 192 has a first spring rate and the second portion 194 has a second spring rate. The second spring rate is greater than the first spring rate. As would be understood, by having two different spring rates, for a given force being applied to the spring assembly 154, the portion having the lower spring rate (i.e. the first portion 192) will be compressed by a larger amount than the portion having the greater spring rate (i.e. second portion 194), and both portions are used in resisting the force. If the force applied is increased, then the portion having the lower spring rate will eventually be fully compressed, and any increase of the force beyond that point will only be resisted by the portion having the greater spring rate. Although spring assembly 154 is shown as a single spring having two portions 192, 194 integrally formed, it is contemplated that the spring assembly 154 could be made of two separate springs, each one corresponding to one of the portions 192, 194.

Turning now to FIGS. 23A to 26B, the manner in which the lifting device 156 can be used to control the behaviour of the suspension will be described. For simplicity, the deck 8 and the HSD assembly have been shown schematically in these figures, and the HSD assembly has been labelled as 190. It should be noted that the movement of the HSD assembly 190 relative to the deck 8 and the amount of compression of the spring assembly 154 have been exaggerated for clarity. The sagged positions (described below) of the deck 8 are shown in dotted lines and are labelled 8'. The initial distances (described below) between the deck 8 and the HSD assembly 190 have been labelled with reference letter I (I1, I2, I3 . . . ). The distances between the deck 8' and the HSD assembly 190 for the sagged positions (described below) have been labelled with reference letter S (S1, S2, S3 . . . ). The lengths of the first portion 192 of the spring assembly 154 have been labelled with reference letter L (L1, L2, L3 . . . ). The lengths of the second portion 194 of the spring assembly 154 have been labelled with reference letter K (K1, K2, K3 . . . ). Throughout FIGS. 23A to 26B, like alphanumeric references correspond to identical distances/lengths. It should be understood that the shorter a portion of the spring assembly 154 is, the more compressed it is. Also, in the explanations provided below, the movement of the parts are described as relative to each other, therefore it should be understood that when a first part is described as moving toward a second part, it has the same effect as the second part moving toward the first part.

Figure 23B:
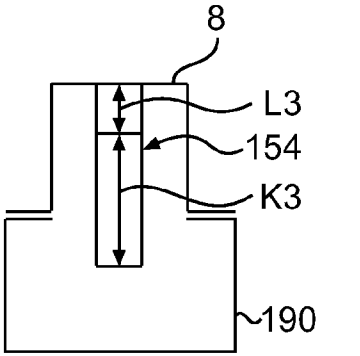
FIGS. 23B, 24B, 25B, and 26B are schematic illustrations of the various bottomed-out positions resulting from the corresponding settings of FIG. 23A, 24A, 25A, and 26A.
Figure 23A:
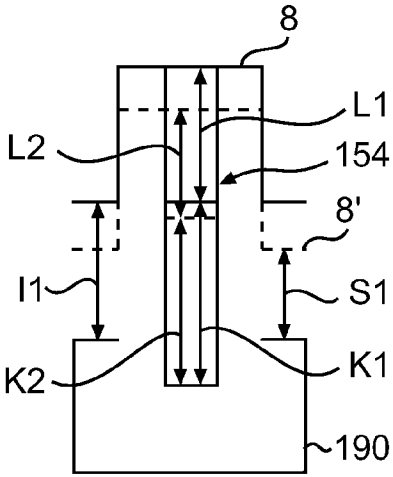
FIGS. 23A, 24A, 25A, and 26A are schematic illustrations of various settings of the suspension elements of the watercraft of FIG. 1.

As previously described, the HSD assembly 190 is movable relative to the deck 8. When the HSD assembly 190 is at its furthest possible position from the deck 8, the position of the HSD assembly 190 is referred to as the topped-out position. In FIG. 23A, the HSD assembly 190 is shown in a topped-out position corresponding to a distance I1 between the HSD assembly 190 and the deck 8. The distance I1 will be determined by the geometry and/or lengths of the suspension arms 14, 76, or the maximum length of the suspension elements 70, or a stopper could be used to limit this distance. When the HSD assembly 190 comes in contact with the deck 8, the position of the HSD assembly 190 is referred to as the bottomed-out position. When the watercraft 2 has rubber mounts 88, as in FIG. 7, the bottomed-out position is when the HSD assembly 190 comes into contact with the rubber mounts 88 and compresses the rubber mounts 88 to their limit. It is contemplated that in some embodiments, the spring assembly 154 may become fully compressed prior to the HSD assembly 190 coming into contact with the deck 8 or that a stopper may be provided to prevent the HSD assembly 190 from contacting the deck 8. Therefore, the bottomed-out position should be understood as the position where the HSD assembly 190 is closest to the deck 8. FIGS. 23B, 24B, 25B, and 26B show the HSD assembly 190 in the bottomed-out position. A full stroke of the suspension element 70, in this case spring assembly 154, corresponds to the total reduction in length of the suspension element 70 as the HSD assembly 190 moves from the topped-out position to the bottomed-out position. In FIGS. 23A to 26B, a full stroke corresponds to a reduction in length of I1 of the spring assembly 154 (i.e. the change in length from FIG. 23A to 23B). The sagged position is the position of the deck 8 relative to the HSD assembly 190 when the driver and passenger and/or cargo are on the deck 8 and no other forces are being applied to the HSD assembly 190.

Turning now to FIG. 23A, the lifting device 156 is set to a position where the HSD assembly 190 is in an initial position corresponding to the topped-out position and is a distance I1 from the deck 8. In this position, the first spring portion 192 has a length L1 and the second spring portion 194 has a length K1. The initial position is the position of the HSD assembly 190 relative to the deck 8 when no driver, passenger, or cargo is on the deck, and the only force on the spring assembly 154 is the weight of the deck 8 (and elements connected to it). When the driver sits on the deck 8, the deck 8 sags to its sagged position that is a distance S1 from the HSD assembly 190. In the sagged position, the first and second spring portions 192, 194 are partly compressed and now have lengths of L2 and K2 which are less than lengths L1 and K1 respectively. When a force is applied to the HSD assembly 190 (when hitting a wave for example), the HSD assembly 190 moves towards the deck 8. If the force is large enough, the HSD assembly 190 will reach the bottomed-out position shown in FIG. 23B. The first spring portion 192 now has length L3, which is its length when fully compressed, and the second spring portion 194 now has length K3. L3 and K3 are less than L2 and K2 respectively. This setting provides a soft suspension since movement through a large portion of the full stroke is resisted mostly by the weaker first portion 192 of the spring assembly 154. This setting also provides a long full stroke.

Figure 24A:
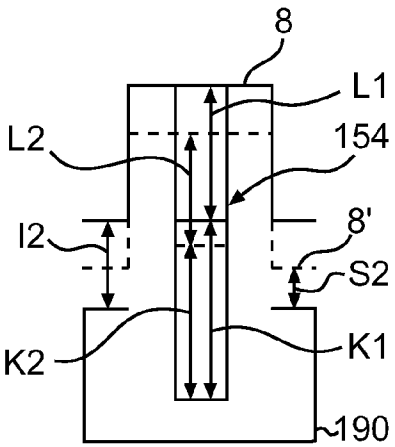
Figure 26B:
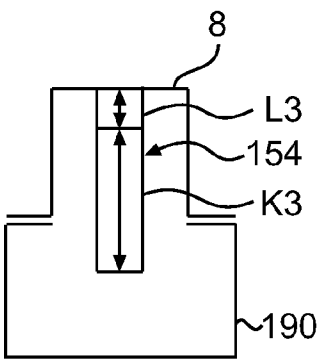

Turning to FIG. 24A, the lifting device 156 is set to a position where the HSD assembly 190 is in an initial position that is closer to the deck 8 than in FIG. 23A and is a distance 12 (less than I1) from the deck 8. In this position, the first spring portion 192 also has a length L1 and the second spring portion 194 also has a length K1, since only the deck 8 is supported thereby. When the driver (the same driver as above) sits on the deck 8, the deck 8 sags to its sagged position that is a distance S2 from the HSD assembly 190. It should be noted that since it is the same driver that sits on the deck in FIG. 24A as in FIG. 23A the difference between 12 and S2 is the same as the difference between I1 and S1. Therefore, in the sagged position, the first and second spring portions 192, 194 are partly compressed and now have lengths of L2 and K2 which are less than lengths L1 and K1 respectively. If a force applied to the HSD assembly 190 is large enough, the HSD assembly 190 will reach the bottomed-out position shown in FIG. 24B. The first spring portion 192 now has length L4 and is still partially expanded, and the second spring portion 194 now has length K4. L4 and K4 are greater than L2 and K2 respectively. Since the first spring portion 192 is not fully compressed, it will be understood that this setting is better suited for riding conditions with small waves since less force is required to move the HSD assembly 190 to the bottomed-out position than for the setting in FIG. 23A, and this setting also has a shorter full stroke than the setting shown in FIG. 23A.

Figure 25B:
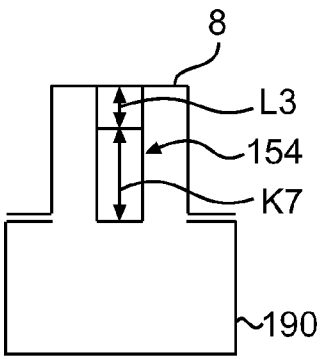
Figure 25A:
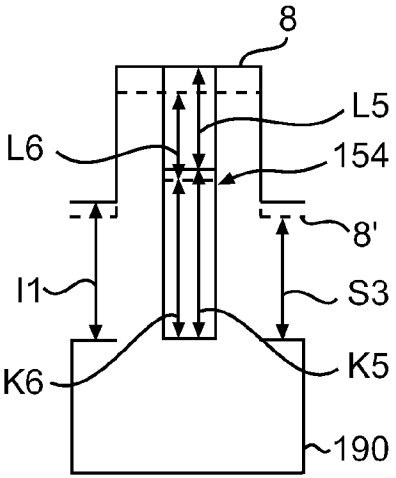

Turning to FIG. 25A, the lifting device 156 is set to a position where the HSD assembly 190 is in an initial position corresponding to the topped-out position and is a distance I1 from the deck 8, but where the lifting device has continued to be raised even when that position has been reached. Since the HSD assembly 190 cannot move further away from the deck 8 than the topped-out position, this results in the spring assembly 154 being compressed in the initial position, which is known as pre-loading the spring assembly 154. In this position, the first spring portion 192 has a length L5 and the second spring portion 194 has a length K5. L5 and K5 are less than L1 and K1 due to the pre-loading. It is contemplated that the spring assembly 154 could be pre-loaded such that the first spring portion 192 is fully compressed, and as such has a length L3 throughout the full stroke. When the driver (the same driver as above) sits on the deck 8, the deck 8 sags to its sagged position that is a distance S3 from the HSD assembly 190. It should be noted that since the spring assembly 154 is pre-loaded, the deck 8 does not sag as much as in FIG. 23A, and the difference between I1 and S3 is less than the difference between I1 and S1. In the sagged position, the first and second spring portions 192, 194 are partly compressed and now have lengths of L6 and K6 which are less than lengths L5 and K5 respectively. If a force applied to the HSD assembly is large enough, the HSD assembly 190 will reach the bottomed-out position shown in FIG. 25B. Since the spring assembly 154 is pre-loaded, the first spring portion 192 is fully compressed (and becomes fully compressed earlier in the full stroke than in FIGS. 23A, 23B) and as such has length L3, and the second spring portion 194 has length K7 that is less than length K3 of FIG. 23B. In a preferred embodiment, the first spring portion 192 becomes fully compressed before a midpoint of the full stroke. This setting is better suited for riding conditions with high waves or for riders who prefer a stiffer suspension.

Figure 26A:
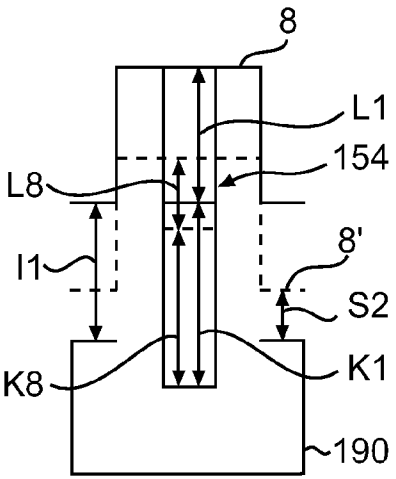

Turning now to FIG. 26A, the lifting device 156 is set to a position where the HSD assembly 190 is in an initial position corresponding to the topped-out position and is a distance I1 from the deck 8. As in FIG. 23A, the first spring portion 192 has a length L1 and the second spring portion 194 has a length K1. When the driver and passenger sits on the deck 8 (or if cargo is added), the deck 8 sags to its sagged position that is a distance S2 from the HSD assembly 190 which the same as in FIG. 24A. In the sagged position, the first and second spring portions 192, 194 are partly compressed and now have lengths of L8 and K8 which are less than lengths L1, L2 and K1, K2 respectively. When a force is applied to the HSD assembly 190 (when hitting a wave for example), the HSD assembly 190 moves towards the deck 8. If the force is large enough, the HSD assembly 190 will reach the bottomed-out position shown in FIG. 26B. The first spring portion 192 now has length L3, which is its length when fully compressed, and the second spring portion 194 now has length K3. This setting allows the sagged position of deck 8' to be the same when passengers or cargo are present on the deck 8 as when only the driver is present, as in FIG. 24A. It should be understood that different initial positions corresponding to different weights on the deck 8 could be set to obtain the same sag position.

It should be understood that the above are only exemplary, and that the length and spring rates of the spring assembly, the actual topped-out and bottom-out positions, and the suspension geometry, will affect how the HSD assembly 190 and deck 8 will move relative to each other, and will also affect when during the full stroke a spring portion becomes fully compressed. It should also be understood that more intermediate positions of the HSD assembly 190 relative to the deck are contemplated.

Figure 27:
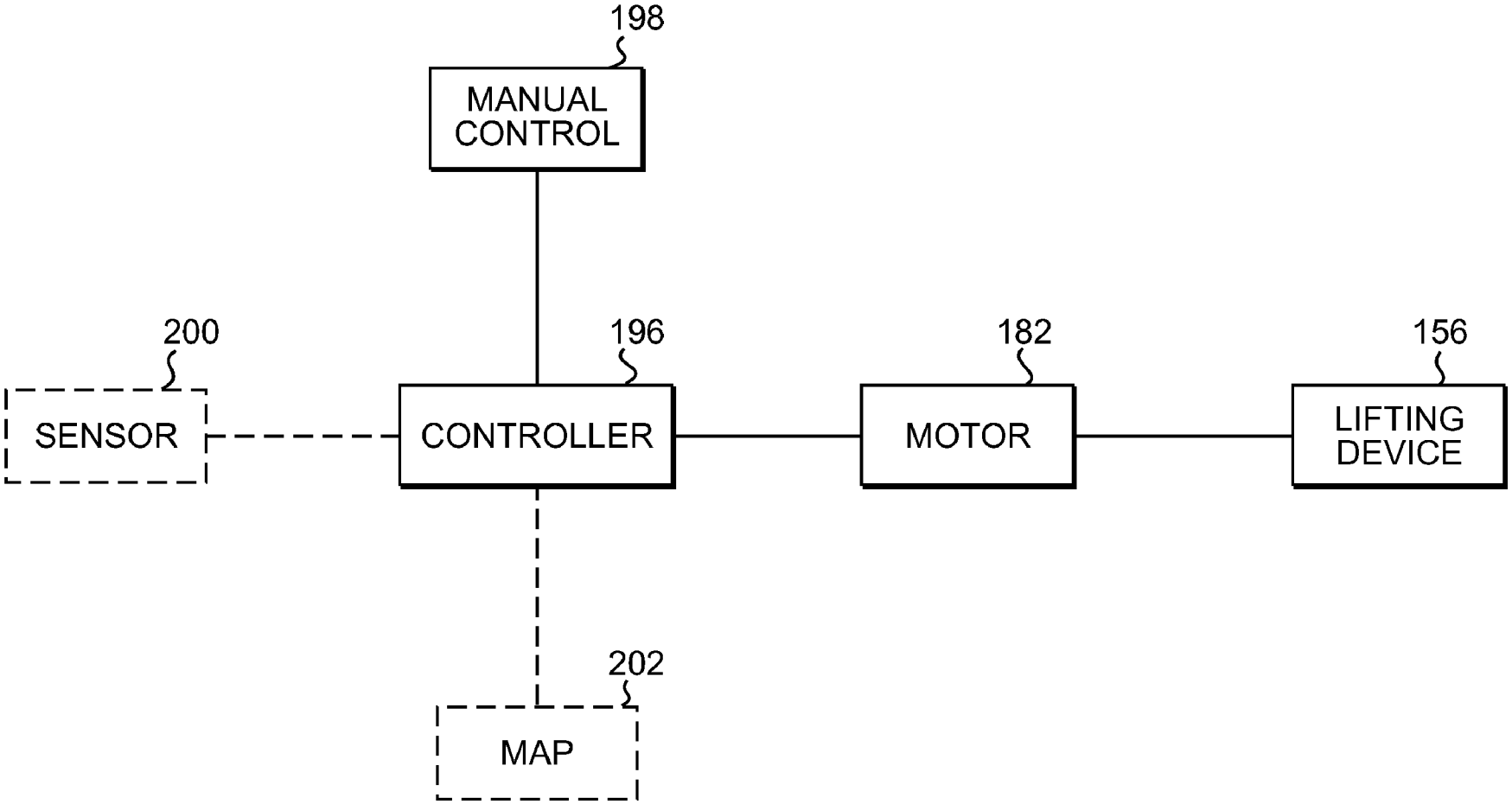
FIG. 27 is a schematic illustration of a controller of the lifting device and associated components.

Referring now to FIG. 27, the position of the lifting device 156, and therefore the initial position of the HSD assembly 190 relative to the deck 8, is controlled by a controller 196. The controller 190 sends signals to the motor 182 which moves the lifting device 156 as previously described. In one embodiment, the driver of the watercraft 2 actuates a manual control 198, such as buttons 132 on the helm assembly 46, which sends a signal to the controller 196 of a desired initial position, the controller then controls the lifting device 156 accordingly. The manual control 198 may be used to increase or decrease the initial position as desired, or alternatively may only select one of a certain number of preset positions of the lifting device 182. In another embodiments, the manual control 198 is used to set the sagged position of the deck 8 relative to the HSD assembly 190. In this embodiment, the driver and, if applicable, passengers and/or cargo are on the deck 8 when the driver actuates the manual control 198, and the driver actuates the manual control 198 until a desired sagged position is obtained. In yet another embodiment, at least one sensor 200 is provided for sensing a position of the deck 8 relative to the HSD assembly 190 and a speed of the deck 8 relative to the HSD assembly 190. The sensor 200 is electrically connected to the controller 196 for providing at least one signal indicative of the position and speed of the deck 8 relative to the HSD 190. The controller 196 then compares the signals received to data stored in one or more maps 202 to determine what the initial distance should be. The controller 196 then controls the lifting device 156 accordingly. In another embodiment, the sensor 200 and maps 202 are used to obtain a desired sagged position. In this embodiment, when the watercraft 2 is started, the controller 196 receives a signal from the sensor 200 indicative of the position of the deck 8 relative to the HSD assembly 190. The controller 196 compares the signal received to data in the maps 202 and then determines if the lifting device 156 needs to be raised or lowered to obtain the desired sagged position. This embodiment allows deck 8 and HSD assembly 190 to be set at always the same sagged position without driver intervention, and this regardless of the weight of the driver, the presence or absence of passengers and/or cargo on the deck 8. It should be understood that in the embodiments described above, the initial distance can be set while the watercraft 2 is operated with a driver and passengers thereon. In these cases, setting the initial distance means moving the lifting device 156 such that the distance would be the distance between the deck 8 and the HSD assembly 190 if no driver, passenger, or cargo were on the deck, and the only force on the spring assembly 154 were the weight of the deck 8 (and elements connected to it). It should also be understood that in the embodiments described above, the sagged position could similarly be set while the watercraft 2 is operated. It is contemplated that when the watercraft 2 is stopped and the key removed, the controller would move the lifting device 156 such that the deck 8 is in the bottomed-out position to avoid unnecessary stress on the suspension elements 70. When the key is re-inserted, the controller 156 would move the lifting device such that the deck 8 is a predetermined distance above the HSD assembly 190 or set it to the last initial position before the key was removed.

Figure 29:
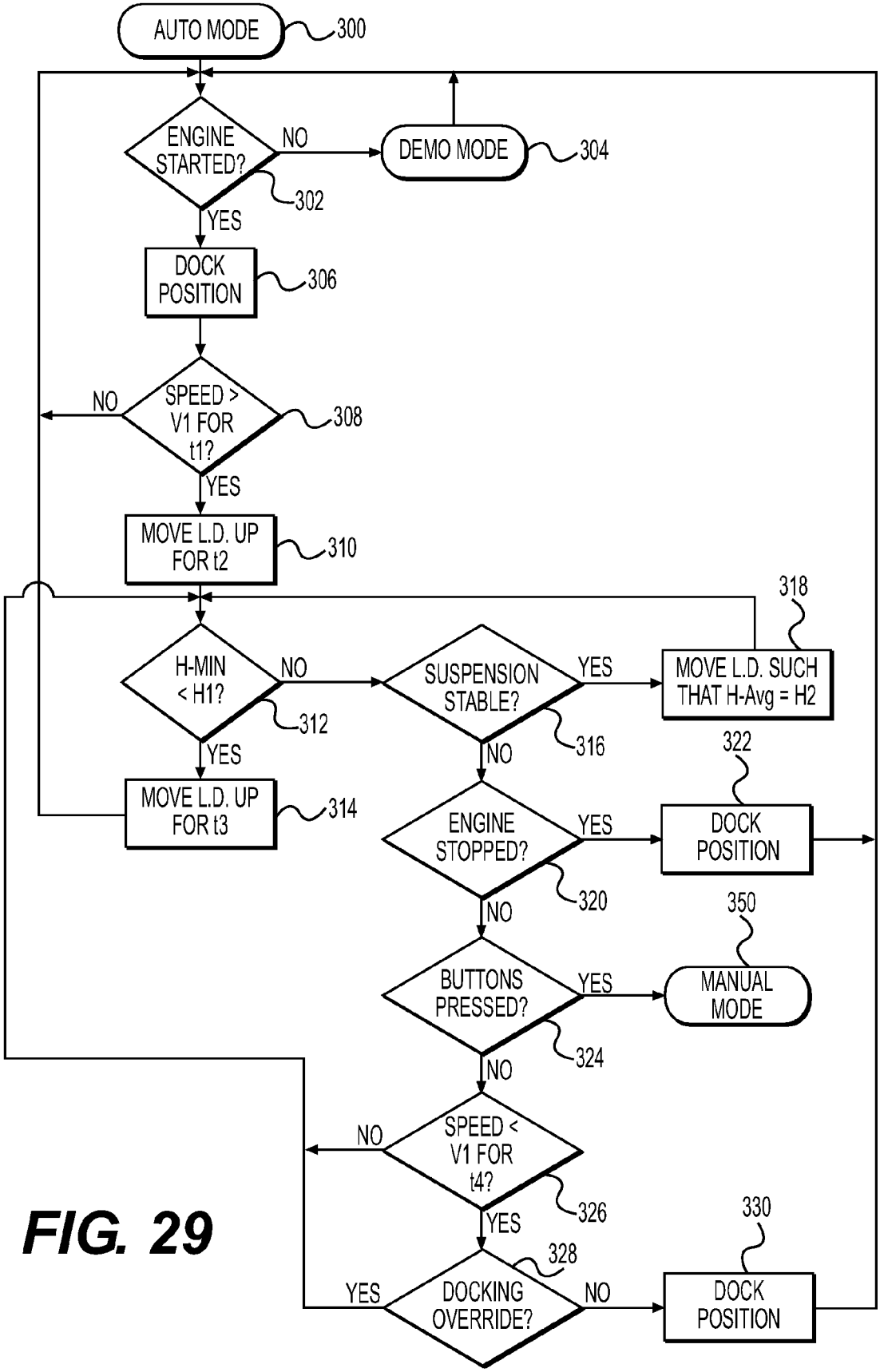
FIG. 29 is a logic diagram illustrating an automatic control mode of a method of controlling the suspension of the watercraft of FIG. 1.
Figure 30:
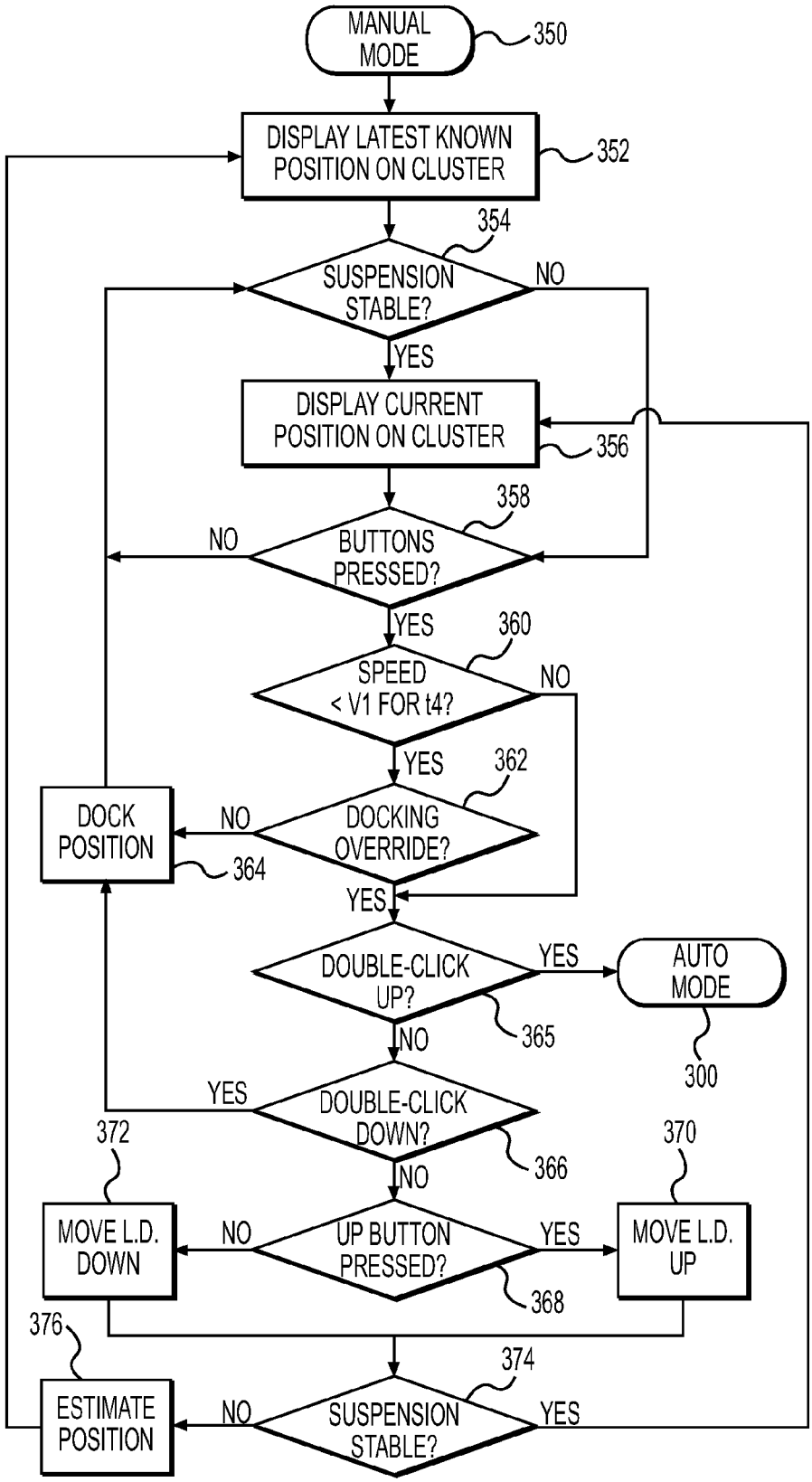
FIG. 30 is a logic diagram illustrating a manual control mode of the method of controlling the suspension of the watercraft of FIG. 1.
Figure 31:
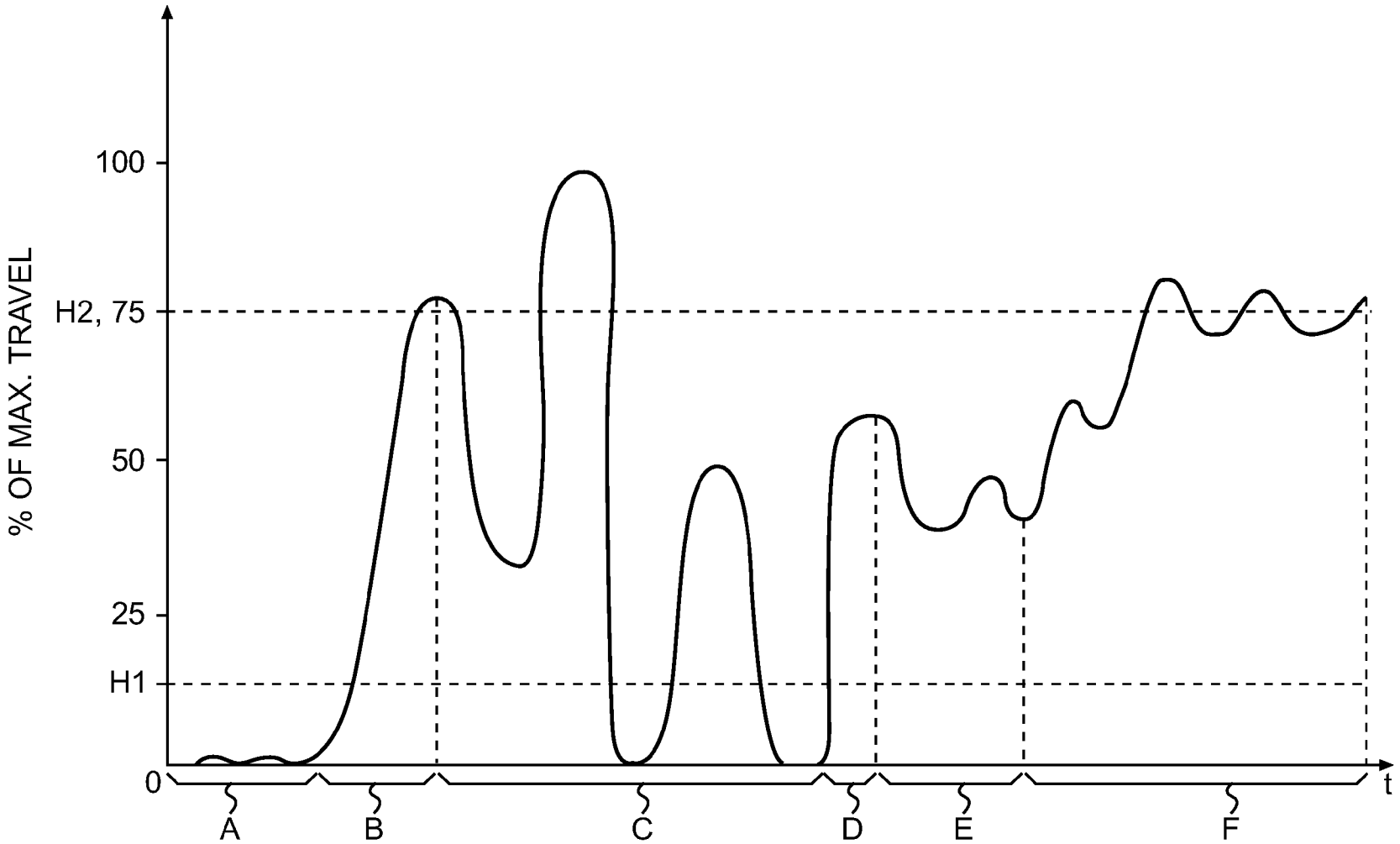
FIG. 31 is a graph illustrating an example of the movement of the deck and sub-deck relative to each other over time resulting from the application of the automatic control mode illustrated in FIG. 29.

Turning now to FIGS. 29 to 31, an alternative method of controlling the position of the lifting device 156 will be described. The method includes three different operation modes: an automatic mode 300 illustrated in FIG. 29, a manual mode 350 illustrated in FIG. 30, and a demo mode 304 (not shown in detail but described below). In this embodiment, the controller 196 receives information regarding the position a position of the deck 8 relative to the HSD assembly 190 from a sensor 200. In a preferred embodiment, the sensor 200 is an angular position sensor provided at the pivot axis 144 of the front suspension arm 76. The angular position sensor senses the position of the front suspension arm 76 from which the position of the deck 8 relative to the HSD assembly 190 can be determined. The controller 196 also receives a signal indicative of a speed of the watercraft 2 from the watercraft speed sensor. The watercraft speed sensor could in the form of a paddle wheel sensor or a GPS for example. The controller 196 also receives a signal indicative of whether the engine 12 is running or not. This signal could be provided by an engine speed sensor (RPM sensor) or from another sensor associated with the engine 12, such as a camshaft speed sensor. The buttons 132 described above, one "up" button and one "down" button, are also used to provide inputs to the controller 196 as described below.

For simplicity, movement of the housing 162 of the lifting device 156 will simply be described below as movement of the lifting device 156. For example, moving the housing 162 of the lifting device 156 up will simply be described as moving the lifting device 156 up.

Turning now to FIG. 29, the automatic control mode 300 will be described. When operating in the automatic control mode 300, an indication that the controller 196 is operating in this mode is displayed on the display cluster 130. The controller 196 first determines at step 302 if the engine 12 has started (i.e. the engine speed is greater than zero). If not, then the controller moves to the demo mode 304. In the demo mode 304, pushing the up button 132 sends a signal to the controller 196 to cause the lifting device 156 to move up which results in the deck 8 moving away from the sub-deck 6, and pushing the down button 132 sends a signal to the controller 196 to cause the lifting device 156 to move down which results in the deck 8 moving towards the sub-deck 6.

If at step 302, the controller 196 determines that the engine 12 has started, then, at step 306, the controller 196 causes the lifting device 156 to move the deck 8 to a dock position. In a preferred embodiment, the dock position corresponds to the bottomed-out position previously described (i.e. the position where the deck 8 is closest to the sub-deck 6). Then at step 308, the controller 196 determines if the speed of the watercraft 2 has been above a predetermined speed V1 for a first predetermined period of time t1. The speed V1 is a relatively low speed and the time t1 is relatively short. For example, it is contemplated that V1 could be 8 km/h and that t1 could be 2 seconds. If at step 308, the speed of the watercraft 2 has not been above the predetermined speed V1 for the first predetermined period of time t1, then the controller 196 returns to step 302. If at step 308, the speed of the watercraft 2 has been above the predetermined speed V1 for the first predetermined period of time t1, then the controller 196 continues to step 310. At step 310, the controller 196 actuates the motor 182 or the hydraulic pump 171 (depending on the embodiment) for a predetermined amount of time t2 so as to raise the lifting device 156 such that the deck 8 is raised relative to the sub-deck 6 from the dock position.

From step 310, the controller 196 determines, at step 312, by using the signals received from the position sensor 200 if during the operation of the watercraft 2, the deck 8 is less than a predetermined distance H1 from the sub-deck 6, which would indicate that the deck 8 is or is close to the bottomed-out position. If that is the case, then at step 314 the controller 196 actuates the motor 182 or the hydraulic pump 171 (depending on the embodiment) for a predetermined amount of time t3 so as to raise the lifting device 156, and the controller 196 returns to step 302. If during the operation of the watercraft 2, the deck 8 is not less than a predetermined distance H1 from the sub-deck 6, then the controller continues to step 316.

At step 316, the controller 196 determines if the suspension is stable. The suspension of the watercraft 2 is considered to be stable if the distance between the deck 8 and the sub-deck 6, as determined from the position sensor 200, remains substantially the same. In a preferred embodiment, the suspension is considered to be stable if the difference between that maximum distance between the deck 8 and the sub-deck 6 and the minimum distance between the deck 8 and the sub-deck 6 is less than 5 percent of the distance between the topped-out and bottomed-out positions. If at step 316 it is determined that the suspension is stable, then at step 318 the lifting device 156 is moved such that the average distance between the deck 8 and the sub-deck 6 is a predetermined distance H2. In a preferred embodiment, H2 corresponds to 75 percent of the distance between the topped-out and bottomed-out positions. From step 318, the controller 196 returns to step 312. If at step 316 it is determined that the suspension is not stable, then the controller 196 goes to step 320.

At step 320, the controller 196 determines if the engine 12 is stopped (i.e. the engine speed is zero). If the engine 12 is stopped, then at step 322 the controller 196 causes the lifting device 156 to move the deck 8 to the dock position, then the controller goes to step 302. If the engine 12 is not stopped, then at step 324, the controller determines if one of the buttons 132 has been pressed. If one of the buttons 132 has been pressed, the controller 196 moves to the manual control mode 350 described below. It is contemplated that if at any time during the automatic control mode 300 any one of the buttons 132 is pressed, that the controller would move to the manual control mode 350. Alternatively, it is contemplated that if at any time during the automatic control mode 300 the up button 132 is pressed, that the controller would move to the manual control mode 350. If the buttons 132 have not been pressed, then the controller goes to step 326.

At step 326, the controller 196 determines if the speed of the watercraft 2 has been below the predetermined speed V1 for a predetermined period of time t4. In a preferred embodiment, time t4 is greater than time t1. If at step 326, the speed of the watercraft 2 has not been below the predetermined speed V1 for the predetermined period of time t4, then the controller 196 returns to step 312. If at step 326, the speed of the watercraft 2 has been below the predetermined speed V1 for the predetermined period of time t4, then the controller 196 continues to step 328. It is contemplated that t4 could be 5 seconds.

At step 328, the controller 196 determines if a docking override switch (not shown) has been activated by the driver of the watercraft 2. The docking override switch is preferably disposed near the display cluster 130 or near the buttons 132. If the docking override switch has not been activated, then at step 330 the controller 196 causes the lifting device 156 to move the deck 8 to the dock position, and the controller then goes to step 302. If the override switch has been activated, then the controller 196 returns to step 312.

Turning now to FIG. 31, a graph illustrating an example of the movement of the deck 8 and the sub-deck 6 relative to each other over time resulting from the application of the automatic control mode 300 will be described. The distance between the deck 8 and the sub-deck 6 is shown on the vertical axis in terms of percentage of the distance between the topped-out and bottomed-out positions. As such, it should be understood that the bottomed-out position is 0 percent and the topped-out position is 100 percent.

When the engine 12 is started, as illustrated by time period A, the deck 8 is moved to the dock position, which in this case is the bottomed-out position, as a result of step 306. Note that the distance can sometimes increase slightly due to waves. Then as the watercraft 2 is accelerated, the deck 8 is raised relative to the sub-deck 6 as a result of step 310 (time period B). As the watercraft 2 continues to operate, it encounter some large waves which causes the minimum distance between the deck 8 and the sub-deck to be less than H1, as illustrated by time period C. As a result of step 314, the controller 196 actuates the motor 182 or the hydraulic pump 171 (depending on the embodiment) for a predetermined amount of time so as to raise the deck 8 relative to the sub-deck 6 as illustrated by time period D. In this particular case, the first application of step 314 results in the suspension becoming stable (time period E). Therefore, as a result of step 318, the lifting device 156 raises the deck 8 relative to the sub-deck 6 such that the average distance between the two corresponds to H2, which in this case is 75% as illustrated by time period F. It should be understood that the above is only one possible example of the results of the application of the automatic control mode 300. The riding conditions, watercraft speed as well as many other factors will affect how the graph of the position of the deck 8 relative to the sub-deck 6 over time looks.

Turning now to FIG. 30, the manual control mode 350 will be described. The first step of the manual control mode 350, step 352, is to display the latest known average position of the deck 8 relative to the sub-deck 6. This position is either the current average position when the suspension was stable prior to entering the manual control mode 350, or an estimated position when the suspension was unstable prior to entering the manual control mode 350. Then at step 354, the controller 196 determines if the suspension is now stable. If it is, the current average position of the deck 8 relative to the sub-deck 6 is displayed on the display cluster 130 at step 356, and the controller then goes to step 358. If the suspension is not stable at step 354, the controller 196 goes directly to step 358.

At step 358, the controller 196 determines if one of the buttons 132 is pressed. If not, then the controller 196 returns to step 354. If one of the buttons 132 is pressed, then the controller 196 goes to step 360.

At step 360, the controller 196 determines if the speed of the watercraft 2 has been below the predetermined speed V1 for the predetermined period of time t4. If at step 360, the speed of the watercraft 2 has been below the predetermined speed V1 for the predetermined period of time t4, then the controller 196 goes to step 362. If at step 360, the speed of the watercraft 2 has not been below the predetermined speed V1 for the predetermined period of time t4, then the controller 196 goes to step 365.

At step 362, the controller 196 determines if the docking override switch has been activated. If not, then at step 364 the controller 196 causes the lifting device 156 to move the deck 8 to the dock position, then the controller returns to step 354. If the docking override switch has been activated, then the controller 196 continues to step 364.

At step 365, the controller 196 determines if the up switch 132 has been "double-clicked" (i.e. pressed in two quick successions). If so, the controller 194 returns to the automatic control mode 300. If not, the controller 196 goes to step 366 and determines if the down switch 132 has been "double-clicked". If the down switch 132 has been "double-clicked", then the controller 196 goes to step 364 (dock position) and then returns to step 354. If the down switch 132 has not been "double-clicked", then the controller continues to step 368.

At step 368, the controller 196 determines if the up switch 132 has been pressed. If so, then at step 370, the controller 196 causes the lifting device 156 to raise the deck 8 relative to the sub-deck 6. If the up switch 132 has not been pressed, then the down switch 132 has been pressed and at step 372 the controller 196 causes the lifting device 156 to lower the deck 8 relative to the sub-deck 6. At steps 370 and 372, the deck 8 will be raised or lowered, as the case may be, for as long as the corresponding button 132 is pressed. However, it is contemplated that the maximum and minimum distances between the deck 8 and the sub-deck 6 that can be set in the manual control mode 350 could be limited. For example, it is contemplated that the minimum distance between the deck 8 and the sub-deck that can be set in the manual control mode 350 would correspond to 45 percent of the distance between the topped-out and bottomed-out positions, and that the maximum distance between the deck 8 and the sub-deck that can be set in the manual control mode 350 would correspond to 85 percent of the distance between the topped-out and bottomed-out positions. It is also contemplated that once one of the buttons 132 is pressed that the controller 196 would cause the lifting device 156 to raise or lower, as the case may be, the deck 8 relative to the sub-deck 6 for a predetermined period of time (i.e. the controller 196 actuates the motor 182 or the hydraulic pump 171 for the predetermined period of time), even if the button 132 is pressed for less than the predetermined amount of time.

From steps 370 and 372, the controller 196 goes to step 374 and determines if the suspension is stable. If it is, then the average distance between the deck 8 and the sub-deck 6 can be determined from the position sensor 200 and this position is displayed at step 356. If the suspension is not stable, then the average distance between the deck 8 and the sub-deck 6 cannot be determined directly from the position sensor 200. Therefore, at step 376 an estimate of this distance is calculated and this position is displayed at step 352.

It should be understood that for at least some of the steps described where determinations are made as to the position of the deck 8 relative to the sub-deck 6, such as for example steps 312, 316, 354, and 374, that these determinations are made over a certain period of time. For example, at step 312, the controller 196 will go to step 314 only if the deck 8 is less than the predetermined distance H1 from the sub-deck 6 a certain number of times within a predetermined period of time. As shown in the example given in FIG. 31, the deck 8 was less than the predetermined distance H1 from the sub-deck 6 twice (see time period C) before the controller applied step 314 (time period D). Although this is the preferred approach, it is contemplated that the determination could be made instantaneously. In this case, in the example of FIG. 31, step 314 (time period D) would have been applied the first time that the deck 8 was less than the predetermined distance H1 from the sub-deck 6.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A personal watercraft comprising:

a hull;

a sub-deck disposed on the hull, the hull and sub-deck together forming a hull and sub-deck (HSD) assembly;

an engine disposed in the HSD assembly;

a propulsion system connected to the hull and operatively connected to the engine;

a deck disposed above the sub-deck, the deck having a pedestal;

a straddle seat disposed on the pedestal;

a helm assembly operatively connected to the propulsion system and disposed at least in part forwardly of the straddle seat;

a suspension member having a first end pivotally connected to the deck and a second end pivotally connected to the HSD assembly, such that the HSD assembly is movable relative to the deck between a topped-out position and a bottomed-out position, the topped-out position being the position where the deck is furthest from the sub-deck, the bottomed-out position being the position where the deck is closest to the sub-deck, the suspension member having a fixed length;

a suspension element connected between any two of the deck, the HSD assembly, and the suspension member, the suspension element including a spring assembly, the spring assembly having a first portion having a first spring rate and a second portion having a second spring rate, the second spring rate being greater than the first spring rate, movement of the HSD assembly from the topped-out position to the bottomed-out position resulting in the suspension element moving through a full stroke of the suspension element;

a lifting device associated with the spring assembly for moving the deck relative to the sub-deck; and a controller associated with the lifting device, the controller controlling the lifting device to set an initial distance between the deck and the sub-deck to one of a first distance and a second distance, the second distance being greater than the first distance, such that:

when the controller controls the lifting device to set the initial distance between the deck and the sub-deck to be the first distance, the suspension element moves through a majority of the full stroke with the first portion of the spring assembly at least partially expanded, and when the controller controls the lifting device to set the initial distance between the deck and the sub-deck to be the second distance, the suspension element moves through a majority of the full stroke with the first portion of the spring assembly fully compressed.

2. The personal watercraft of claim 1, wherein the spring assembly is a dual rate spring having the first and second portions of the spring assembly integrally formed.

3. The personal watercraft of claim 1, wherein the suspension element is a first suspension element; and further comprising a second suspension element including a hydraulic damper, the second suspension element being connected between any two of the deck, the HSD assembly, and the suspension member.

4. The personal watercraft of claim 3, wherein the hydraulic damper is a dual rate hydraulic damper.

5. The personal watercraft of claim 1, wherein the lifting device forms part of the suspension element.

6. The personal watercraft of claim 5, wherein a first portion of the lifting device is pivotally connected to one of the HSD assembly and the suspension member, a second portion of the lifting device opposite the first portion of the lifting device is connected to one of the first and second portions of the spring assembly, and an other of the first and second portions of the spring assembly is connected to the deck.

7. The personal watercraft of claim 6, wherein the first portion of the lifting device has a piston formed at an end thereof opposite an end that is pivotally connected to the suspension member;

wherein the second portion of the lifting device is disposed around the piston and is slidable relative to the first portion of the lifting device;

wherein a first chamber having an adjustable volume is formed between the second portion of the lifting device and the piston;

wherein the lifting device further includes an inlet fluidly communicating with the first chamber for introducing hydraulic fluid in the first chamber, such that when hydraulic fluid is introduced in the first chamber, the volume of the first chamber increases.

8. The personal watercraft of claim 7, further comprising:

a hydraulic cylinder including:

a cylinder housing;

a piston disposed in the cylinder housing, the cylinder housing and the piston together form a second chamber having an adjustable volume;

an outlet fluidly communicating with the second chamber for allowing hydraulic fluid to leave the second chamber, the outlet fluidly communicating with the inlet of the first chamber of the lifting device;

a piston rod having a first end connected to the piston and a second threaded end; and a threaded rod associated with the threaded end of the piston rod; and a motor operatively connected to the threaded rod for turning the threaded rod, such that turning the threaded rod moves the piston rod and the piston linearly in the cylinder housing to change the volume of the second chamber;

wherein operation of the motor is controlled by the controller; and wherein turning the threaded rod to reduce the volume of the second chamber causes hydraulic fluid to leave the second chamber and enter the first chamber to increase the volume of the first chamber.

9. The personal watercraft of claim 1, further comprising at least one sensor for sensing a position of the deck relative to the HSD assembly and a speed of the deck relative to the HSD assembly, the at least one sensor being electrically connected to the controller for providing at least one signal indicative of the position and speed of the deck relative to the HSD; and wherein the controller includes at least one map used for determining the initial distance to be set based on the at least one signal, and the controller controls the lifting device to set the initial distance based on the map.

10. The personal watercraft of claim 1, wherein the controller includes at least one manual control disposed on the helm assembly; and wherein actuating the at least one manual control controls the lifting device.

11. A personal watercraft comprising:

a hull;

a sub-deck disposed on the hull, the hull and sub-deck together forming a hull and sub-deck (HSD) assembly;

an engine disposed in the HSD assembly;

a propulsion system connected to the hull and operatively connected to the engine;

a deck disposed above the sub-deck, the deck having a pedestal;

a straddle seat disposed on the pedestal;

a helm assembly operatively connected to the propulsion system and disposed at least in part forwardly of the straddle seat;

a suspension member having a first end pivotally connected to the deck and a second end pivotally connected to the HSD assembly, such that the HSD assembly is movable relative to the deck between a topped-out position and a bottomed-out position, the topped-out position being the position where the deck is furthest from the sub-deck, the bottomed-out position being the position where the deck is closest to the sub-deck, the suspension member having a fixed length;

a suspension element connected between any two of the deck, the HSD assembly, and the suspension member, the suspension element including a spring assembly, the spring assembly having a first portion having a first spring rate and a second portion having a second spring rate, the second spring rate being greater than the first spring rate, movement of the HSD assembly from the topped-out position to the bottomed-out position resulting in the suspension element moving through a full stroke of the suspension element;

a lifting device associated with the spring assembly for moving the deck relative to the sub-deck; and a controller associated with the lifting device, the controller controlling the lifting device to set a sagged position of the deck relative to the sub-deck to one of a first position and a second position, the second position being at greater distance from the sub-deck than the first position, such that:

when the controller controls the lifting device to set the sagged position to be the second position, the suspension element moves from a midpoint of the full stroke to an end of the full stroke with the first portion of the spring assembly fully compressed.

12. The personal watercraft of claim 11, wherein when the controller controls the lifting device to set the sagged position to be the first position, the suspension element moves from a beginning of the full stroke to the end of the full stroke with the first portion of the spring assembly at least partially expanded.

13. The personal watercraft of claim 11, wherein the spring assembly is a dual rate spring having the first and second portions of the spring assembly integrally formed.

14. The personal watercraft of claim 11, wherein the suspension element is a first suspension element; and further comprising a second suspension element including a hydraulic damper, the second suspension element being connected between any two of the deck, the HSD assembly, and the suspension member.

15. The personal watercraft of claim 14, wherein the hydraulic damper is a dual rate hydraulic damper.

16. The personal watercraft of claim 11, wherein the lifting device forms part of the suspension element.

17. The personal watercraft of claim 16, wherein a first portion of the lifting device is pivotally connected to one of the HSD assembly and the suspension member, a second portion of the lifting device opposite the first portion of the lifting device is connected to one of the first and second portions of the spring assembly, and an other of the first and second portions of the spring assembly is connected to the deck.

18. The personal watercraft of claim 17, wherein the first portion of the lifting device has a piston formed at an end thereof opposite an end that is pivotally connected to the suspension member;

wherein the second portion of the lifting device is disposed around the piston and is slidable relative to the first portion of the lifting device;

wherein a first chamber having an adjustable volume is formed between the second portion of the lifting device and the piston;

wherein the lifting device further includes an inlet fluidly communicating with the first chamber for introducing hydraulic fluid in the first chamber, such that when hydraulic fluid is introduced in the first chamber, the volume of the first chamber increases.

19. The personal watercraft of claim 18, further comprising:

a hydraulic cylinder including:

a cylinder housing;

a piston disposed in the cylinder housing, the cylinder housing and the piston together form a second chamber having an adjustable volume;

an outlet fluidly communicating with the second chamber for allowing hydraulic fluid to leave the second chamber, the outlet fluidly communicating with the inlet of the first chamber of the lifting device;

a piston rod having a first end connected to the piston and a second threaded end; and a threaded rod associated with the threaded end of the piston rod; and a motor operatively connected to the threaded rod for turning the threaded rod, such that turning the threaded rod moves the piston rod and the piston linearly in the cylinder housing to change the volume of the second chamber;

wherein operation of the motor is controlled by the controller; and wherein turning the threaded rod to reduce the volume of the second chamber causes hydraulic fluid to leave the second chamber and enter the first chamber to increase the volume of the first chamber.

20. The personal watercraft of claim 11, further comprising at least one sensor for sensing a position of the deck relative to the HSD assembly and a speed of the deck relative to the HSD assembly, the at least one sensor being electrically connected to the controller for providing at least one signal indicative of the position and speed of the deck relative to the HSD; and wherein the controller includes at least one map used for determining the sagged position to be set based on the at least one signal, and the controller controls the lifting device to set the sagged position based on the map.

21. The personal watercraft of claim 11, wherein the controller includes at least one manual control disposed on the helm assembly; and wherein actuating the at least one manual control controls the lifting device.

* * * * *